US007284391B2

(12) United States Patent
Miller et al.

(10) Patent No.: US 7,284,391 B2
(45) Date of Patent: Oct. 23, 2007

(54) PUMP ASSEMBLY FOR AN ICE MAKING MACHINE

(75) Inventors: Richard T. Miller, Manitowoc, WI (US); Michael C. Hollen, Manitowoc, WI (US); Howard G. Funk, Manitowoc, WI (US); Marty J. Lafond, Algoma, WI (US); Charles E. Schlosser, Manitowoc, WI (US)

(73) Assignee: Manitowoc Foodservice Companies, Inc., Sparks, NV (US)

( * ) Notice: Subject to any disclaimer, the term of this patent is extended or adjusted under 35 U.S.C. 154(b) by 723 days.

(21) Appl. No.: 10/746,243

(22) Filed: Dec. 23, 2003

(65) Prior Publication Data

US 2004/0226312 A1 Nov. 18, 2004

Related U.S. Application Data

(63) Continuation-in-part of application No. 09/910,437, filed on Jul. 19, 2001, now Pat. No. 6,705,107, which is a continuation-in-part of application No. 09/800,105, filed on Mar. 5, 2001, now abandoned, which is a continuation of application No. 09/363,754, filed on Jul. 29, 1999, now Pat. No. 6,196,007.

(60) Provisional application No. 60/103,437, filed on Oct. 6, 1998.

(51) Int. Cl.
*F25C 1/12* (2006.01)

(52) U.S. Cl. ..... 62/347; 417/423.14

(58) Field of Classification Search ..... 417/423.1, 417/423.14, 423.15, 424.1; 62/347
See application file for complete search history.

(56) References Cited

U.S. PATENT DOCUMENTS 2,513,735 A 7/1950 Nardone
2,626,086 A * 1/1953 Forrest ..... 222/385
3,289,430 A 12/1966 Dedricks et al.
3,407,739 A 10/1968 Myers
3,814,086 A * 6/1974 Lemb ..... 601/167
4,044,568 A 8/1977 Hagen
4,557,672 A 12/1985 Levine
4,580,410 A 4/1986 Toya
4,767,286 A 8/1988 Kohl et al.
5,167,132 A 12/1992 Meier
5,489,188 A * 2/1996 Meyer et al. ..... 415/119
5,950,866 A 9/1999 Lancaster
6,158,709 A 12/2000 Culp et al.
6,227,821 B1 * 5/2001 Leu et al. ..... 417/423.14

(Continued)

OTHER PUBLICATIONS

Publication, Grainger Catalog, 75th Anniversary, p. 3127.
Publication, Johnstone Supply, Wholesale Catalog #192, pp. 706 and 709.

*Primary Examiner*—William E. Tapolcai
(74) *Attorney, Agent, or Firm*—Brinks, Hofer Gilson & Lione

(57) ABSTRACT

An ice making machine has a mechanical compartment and a water compartment that houses a water system, and a pump assembly. The pump assembly includes a motor and a pump housing connected to the motor. The pump assembly is mounted to a base between the machine compartment and the water compartment so that the pump motor is located in the mechanical compartment, but can still be removed through the water compartment. A mounting flange attached to the pump assembly extends radially beyond the circumference of the pump motor. In one embodiment, a pump opening in the base has a collar integrally formed with the base. The collar includes a sealing section and a latching section. When the pump is inserted through the pump opening, snap latches in the latching section engage the mounting flange to hold the pump in place and the sealing flange seals against an inner surface of the sealing section.

55 Claims, 23 Drawing Sheets

U.S. PATENT DOCUMENTS 6,234,278 B1 5/2001 Loken et al.
6,345,964 B1 * 2/2002 Cooper ..... 417/423.3
6,484,530 B1 * 11/2002 Hibino et al. ..... 62/347

* cited by examiner

L1
L2
87
254
256
91
92
252
50
93
56
12
R
R
R
S
C
S
S
5
2
1
54
88

L1
L2
L3
87
254
256
91
L2
L1
L3
T2
T3
T1
12
252
50

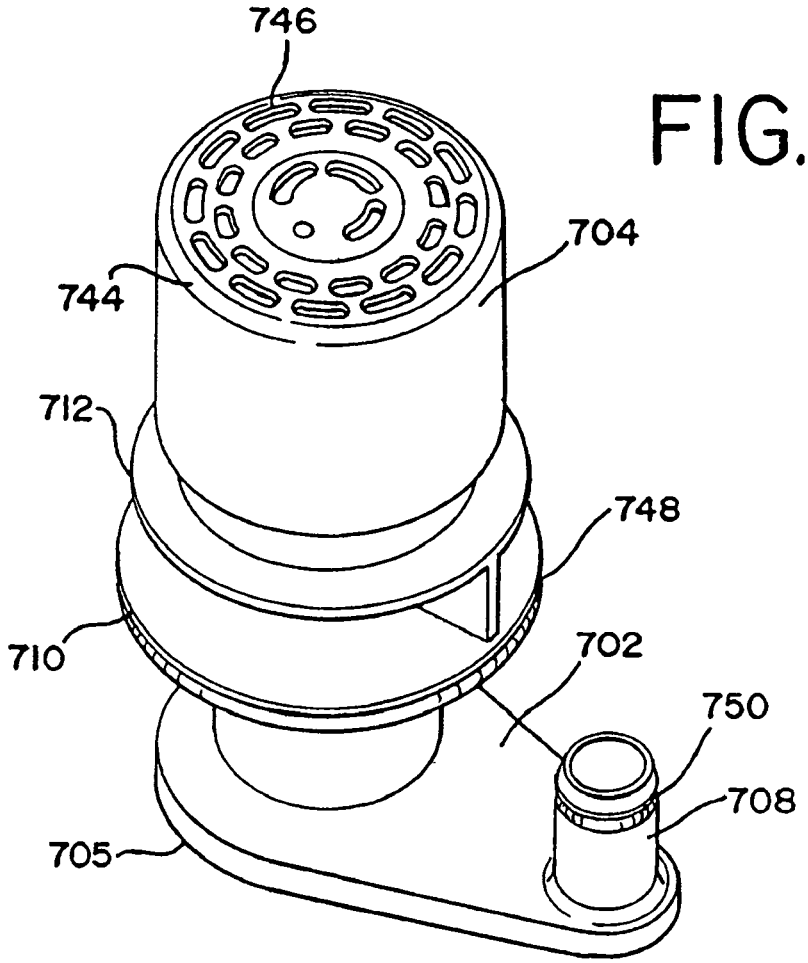
FIG.31
FIG.30
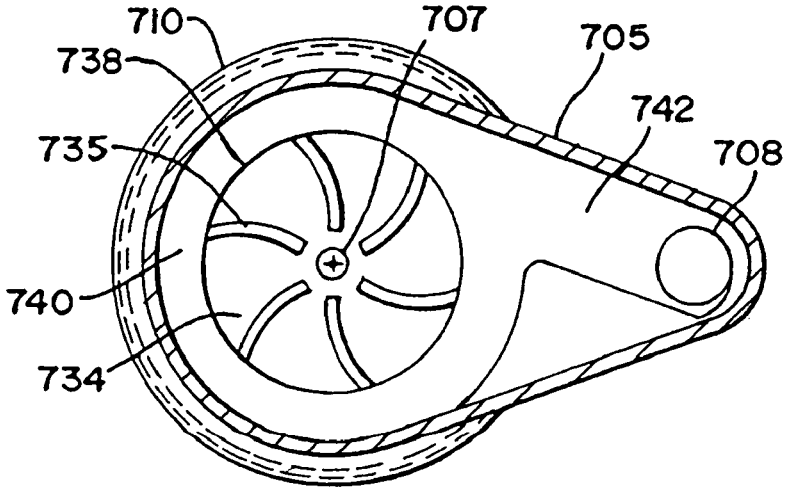

PUMP ASSEMBLY FOR AN ICE MAKING MACHINE

REFERENCE TO EARLIER FILED APPLICATIONS

The present application is a continuation-in-part of application Ser. No. 09/910,437 filed Jul. 19, 2001, now U.S. Pat. No. 6,705,107 which is a continuation-in-part of application Ser. No. 09/800,105, filed Mar. 5, 2001, now abandoned which is a continuation of application Ser. No. 09/363,754, filed Jul. 29, 1999, now U.S. Pat. No. 6,196,007, which claims the benefit of the filing date under 35 U.S.C. § 119(e) of Provisional U.S. Patent Application Ser. No. 60/103,437 filed Oct. 6, 1998. Each of the foregoing applications are hereby incorporated by reference.

BACKGROUND

The present invention relates to automatic ice making machines and, more particularly, to pump assemblies for automatic ice making machines.

Automatic ice making machines rely on refrigeration principles well-known in the art. During an ice making mode, the machines transfer refrigerant from the condensing unit to the evaporator to chill the evaporator and an ice-forming evaporator plate below freezing. Water is then run over or sprayed onto the ice-forming evaporator plate to form ice. Once the ice has fully formed, a sensor switches the machine from an ice production mode to an ice harvesting mode. During harvesting, the evaporator must be warmed slightly so that the frozen ice will slightly thaw and release from the evaporator plate into an ice collection bin. To accomplish this, most prior art ice making machines use a hot gas valve that directs hot refrigerant gas routed from the compressor straight to the evaporator, bypassing the condenser.

In a typical automatic ice making machine, the compressor and condenser unit generates a large amount of heat and noise. As a result, ice machines have typically been located in a back room of an establishment, where the heat and noise do not cause as much of a nuisance. This has required, however, the ice to be carried from the back room to where it is needed. Another problem with having the ice machine out where the ice is needed is that in many food establishments, space out by the food service area is at a premium, and the bulk size of a normal ice machine is poor use of this space.

Several ice making machines have been designed in an attempt to overcome these problems. In typical "remote" ice making machines, the condenser is located at a remote location from the evaporator and the compressor. This allows the condenser to be located outside or in an area where the large amount of heat it dissipates and the noise from the condenser fan would not be a problem. However, the compressor remains close to the evaporator unit so that it can provide the hot gas used to harvest the ice. While a typical remote ice making machine solves the problem of removing heat dissipated by the condenser, it does not solve the problem of the noise and bulk created by the compressor.

Other ice machine designs place both the compressor and the condenser at a remote location. These machines have the advantage of removing both the heat and noise of the compressor and condenser to a location removed from the ice making evaporator unit. For example, U.S. Pat. No. 4,276,751 to Saltzman et al. describes a compressor unit connected to one or more remote evaporator units with the use of three refrigerant lines. The first line delivers refrigerant from the compressor unit to the evaporator units, the second delivers hot gas from the compressor straight to the evaporator during the harvest mode, and the third is a common return line to carry the refrigerant back from the evaporator to the compressor. The device disclosed in the Saltzman patent has a single pressure sensor that monitors the input pressure of the refrigerant entering the evaporator units. When the pressure drops below a certain point, which is supposed to indicate that the ice has fully formed, the machine switches from an ice making mode to a harvest mode. Hot gas is then piped from the compressor to the evaporator units.

U.S. Pat. No. 5,218,830 to Martineau also describes a remote ice making system. The Martineau device has a compressor unit connected to one or more remote evaporator units through two refrigerant lines: a supply line and a return line. During an ice making mode, refrigerant passes from the compressor to the condenser, then through the supply line to the evaporator. The refrigerant vaporizes in the evaporator and returns to the compressor through the return line. During the harvest mode, a series of valves redirect hot, high pressure gas from the compressor through the return line straight to the evaporator to warm it. The cold temperature of the evaporator converts the hot gas into a liquid. The liquid refrigerant exits the evaporator and passes through a solenoid valve and an expansion device to the condenser. As the refrigerant passes through the expansion device and the condenser it vaporizes into a gas. The gaseous refrigerant then exits the condenser and returns to the compressor.

One of the main drawbacks of these prior systems is that the long length of the refrigerant lines needed for remote operation causes inefficiency during the harvest mode. This is because the hot gas used to warm the evaporator must travel the length of the refrigeration lines from the compressor to the evaporator. As it travels, the hot gas loses much of its heat to the lines' surrounding environment. This results in a longer and more inefficient harvest cycle. In addition, at long distances and low ambient temperatures, the loss may become so great that the hot gas defrost fails to function properly at all.

Some refrigeration systems that utilize multiple evaporators in parallel have been designed to use hot gas to defrost one of the evaporators while the others are in a cooling mode. For example, in a grocery store with multiple cold and frozen food storage and display cabinets, one or more compressors may feed a condenser and liquid refrigerant manifold which supplies separate expansion devices and evaporators to cool each cabinet. A hot gas defrost system, with a timer to direct the hot gas to one evaporator at a time, is disclosed in U.S. Pat. No. 5,323,621. Hot gas defrosting in such systems is effective even though the compressor is located remotely from the evaporators due to the large latent heat load produced by the refrigerated fixtures in excess of the heat required to defrost selected evaporator coils during the continued refrigeration of the remaining fixtures. While there are some inefficiencies and other problems associated with such systems, a number of patents disclose improvements thereto, such as U.S. Pat. Nos. 4,522,037 and 4,621,505. These patents describe refrigeration systems in which saturated refrigerant gas is used to defrost one of several evaporators in the system. The refrigeration systems include a surge receiver and a surge control valve which allows hot gas from the compressor to bypass the condenser and enter the receiver. However, these systems are designed for use with multiple evaporators in parallel, and would not function properly if only a single evaporator, or if multiple evaporators in series, were used. Perhaps more importantly, these systems are designed for installations in which the cost of running refrigerant lines between compressors in an equipment room, an outdoor condenser, and multiple evaporators in the main part of a store is not a significant factor in the design. These refrigeration systems would not be cost effective, and perhaps not even practicable, if they were applied to ice making machines.

A good example of such a situation is U.S. Pat. No. 5,381,665 to Tanaka, which describes a refrigeration system for a food showcase that has two evaporators in parallel. A receiver supplies vaporous refrigerant to the evaporators through the same feed line as is used to supply liquid refrigerant to the evaporators. The system has a condenser, compressor and evaporators all located separately from one another. Such a system would not be economical if applied to ice machines where different sets of refrigerant lines had to be installed between each of the locations of the various parts. Moreover, if the compressor and its associated components were moved outdoors to be in close proximity to a remote condenser, the system would not be able to harvest ice at low ambient temperature because the receiver would be too cold to flash off refrigerant when desired to defrost the evaporators.

U.S. Pat. No. 5,787,723 discloses a remote ice making machine which overcomes the drawbacks mentioned above. One or more remote evaporating units are supplied with refrigerant from a remote condenser and compressor. Moreover, if a plurality of evaporating units are used, they can be operated independently in a harvest or ice making mode. The heat to defrost the evaporators in a harvest mode is preferably supplied from a separate electrical resistance heater. While electrical heating elements have proved satisfactory for harvesting ice from the evaporator, they add to the expense of the product. Thus, a method of harvesting the ice in the remote ice machine of U.S. Pat. No. 5,787,723 without electrical heating elements would be a great advantage. An ice making machine that includes a defrost system that utilizes refrigerant gas and can be used where the system has only one evaporator, or an economically installed system with multiple evaporators that also operates at low ambient conditions, would also be an advantage.

Another drawback to conventional ice making machines is their large size. In order to produce sufficient quantities of ice, large components are needed. A large cabinet is needed to house all of these components. When an ice machine is placed on top of a large ice bin in the back room of an establishment, its size is not much of a problem. However, as noted above, space out in the food service area, where the ice is needed, is often at a premium.

In addition, many ice machines are selected so that they will produce ice at a rate which meets overall daily demand at their location. However, often the demand for ice hits a peak, such as lunch time at a drive-up window on a hot day. It is not practical to install an ice machine at the drive-up window that can meet peak demand. Rather, it is more practical to have a smaller capacity ice machine and a storage bin that can accumulate ice in advance of peak demand. The storage bin is frequently built into the top of an ice and beverage dispenser. It would be advantageous if the ice machine were to sit on top of the dispenser and discharge into the bin. That would eliminate the need to transport ice from where it is produced into the top of the ice and beverage dispenser. However, the distance from the counter top where the dispenser is located to the top of the ceiling then limits how tall the combined ice machine and dispenser can be.

It would be of further advantage if the ice machine and bin arrangement allowed for ice to be dumped into the bin from a bucket filled from a different location to meet peak demand. Thus it would be beneficial if the ice machine could be configured to have a smaller "footprint" than the standard size opening on top of an ice storage area of an ice and beverage dispenser. Even if it is not necessary to dump extra ice into a storage bin underneath an ice machine, it would be beneficial if an ice machine were small enough so that a person could have access to clean the dispenser. Standard dispensers are 22, 24, 30 and 42 inches wide, and often about 24-28 inches deep. The ice storage bin may have an internal depth of less than 27 inches. Therefore, it would be beneficial if the cabinet of an ice machine were less than 18 inches deep, and more preferably less than 16 inches deep.

Once an ice machine is installed on top of an ice and beverage dispenser, it is cumbersome to service the ice machine from its rear. Thus, it would also be beneficial if components that may require service or exchange were accessible from the front of the machine. Water pumps have conventionally been located in the front of ice machines so that they can be replaced easily if needed. However, it is desirable to keep the motor of a pump assembly outside of the compartment where the water is being frozen into ice, both to protect the motor from getting wet, and to remove the possible source of contamination associated with a motor. Locating the pump motor outside of the water compartment, but arranging it so that the pump assembly could be removed from the front of the machine, if needed, especially in a compact machine, would be very desirable.

BRIEF SUMMARY

An ice making machine includes a water pump assembly that has the water pump motor located outside of the water compartment, yet the pump assembly can still be removed from the front of the machine for service. The water pump assembly is mounted within the ice making machine, such that the water pump motor is located outside of the water compartment of the ice making machine. The unique water pump assembly can be removed through the face of the machine without the use of any tool.

In one aspect of the invention, a pump assembly includes a pump housing that is attached to a pump motor and encloses an impeller. A discharge tube is connected to the pump housing. A first flange and a second flange extend from the pump assembly. The first flange has a larger diameter than the second flange. The first flange also has a circumferential O-ring seat. At least two braces are positioned between and connected to the first flange and the second flange.

In another aspect of the invention, a pump assembly is mounted within an ice machine that includes a base having an opening and a collar surrounding the opening. The collar has an upper rim in an interior surface thereof and a sealing surface displaced away from the upper rim. A pump housing is attached to a pump motor and encloses an impeller and a discharge tube. A first flange and a second flange extend from the pump assembly, where the first flange has a larger diameter than the second flange. The first flange also has a circumferential seat and an O-ring within the circumferential seat. The O-ring seals the first flange against the sealing surface of the collar. The second flange is configured to fit against the upper rim in the interior surface of the collar, and the collar exerts pressure on the second flange to hold the pump assembly in place.

In yet another aspect of the invention, a pump assembly is mounted in an ice machine that includes a base having a pump opening in a floor thereof. A collar projects above the floor and surrounds the pump opening. The collar includes a first collar section having a first diameter and a segmented collar section having a second diameter and an upper rim. The first diameter is greater than the second diameter. Opposing collar segments reside in the segmented collar section and each of the opposing collar segments has a beveled projection on an inner surface thereof. A pump housing is attached to a pump motor and encloses an impeller. The pump assembly also includes a discharge tube. A first flange and a second flange extend from the pump assembly where the first flange has a larger diameter than the second flange. An upper perimeter portion of the second flange presses against the upper rim.

In still another aspect of the invention, a pump assembly includes a mounting base having a floor and a pump opening in the floor. The pump housing is attached to a pump motor and the pump housing is positioned within the pump opening. A collar surrounds the pump opening and projects above the floor. The collar has a sealing section and a latching section and the interior diameter of the sealing section is greater than the interior diameter of the latching section. The the latching section of the collar has an upper lip. Opposed snap latches reside in the latching section each having an inner surface and a beveled projection extending from the inner surface. A mounting flange extends from the pump assembly. The mounting flange has an upper surface and a lower surface and a peripheral portion. The peripheral portion engages the opposed snap latches, such that the lower surface presses against the beveled projection of the opposed snap latches and the upper surface presses against: the upper lip to hold the pump motor and pump housing in place.

In a further aspect of the invention, a pump assembly includes a pump housing attached to a pump motor and encloses an impeller. The pump assembly also includes a discharge tube. A first flange and a second flange extend from the pump assembly. The first flange has a larger diameter than the second flange and has a circumferential O-ring seat. At least two braces are positioned between and connected to the first flange and the second flange.

In a still further aspect of the invention, a method of mounting a pump assembly in an ice machine includes providing a mounting base having a pump opening and a collar surrounding the pump opening, where the collar has opposed snap latches. A pump motor and pump housing attached to the pump motor are provided, where the pump assembly has a mounting flange and a sealing flange, and where the sealing flange is configured to seal against a sealing surface of the collar. The pump motor and pump housing are inserted into the pump opening until the snap latches engage the mounting flange and the sealing flange seals against the sealing surface. Once installed in the mounting base, the pump motor resides above the mounting base and at least a portion of the pump housing resides below the mounting base.

In a still further aspect of the invention, an ice making unit includes a cabinet having a front panel covering a front panel opening. A water compartment resides behind the front panel and a divider resides between the mechanical compartment and the water compartment. The divider has an opening therein and a collar surrounds the opening. The collar has snap latches therein. A pump assembly includes a motor and a pump housing and the pump housing has a mounting flange. The pump assembly extends though the opening, such that the motor resides in the mechanical compartment and the pump housing resides in the water compartment and the snap latches engage the mounting flange to hold the pump motor and pump housing in place.

In still another aspect of the invention, a pump assembly includes a motor enclosed within a cowling and a pump housing attached to the pump motor. A sleeve surrounds a shaft extending from the pump motor. An impeller housing encloses an impeller attached to an end of the shaft. A discharge tube is down stream from the impeller. A flange surrounds the sleeve, and the flange extends outwardly from the sleeve beyond an outer edge of the motor cowling.

In yet another aspect of the invention, a combination includes a pump assembly and an ice machine mounting base. The mounting base has a floor and a pump opening in the floor. A pump housing is attached to a pump motor, wherein the pump housing is positioned within the pump opening. A collar surrounds the pump opening and projects above the floor. The collar has an upper lip and inwardly extending protrusions on an inner surface thereof. A flange extends from the pump assembly, the flange having an upper surface and a lower surface and a peripheral portion. The peripheral portion engages the collar, such that the lower surface rests on the protrusions and the upper surface presses against the upper lip to hold the pump motor and pump housing in place.

In still another embodiment, a pump assembly includes a pump housing attached to a pump motor and enclosing an impeller. A discharge tube is positioned down stream from the impeller. A first flange and a second flange extend from the pump assembly, the first flange having a larger diameter than the second flange. At least two braces are positioned between and connected to the first flange and the second flange.

This application discloses other inventions relating to the ice machine itself, referred to as aspects one to eight enumerated below.

In one aspect, the invention is an ice making machine comprising: a) a water system including a pump, an ice-forming mold and interconnecting lines therefore; and b) a refrigeration system including a compressor, a condenser, an expansion device, an evaporator in thermal contact with the ice-forming mold, and a receiver, the receiver having an inlet connected to the condenser, a liquid outlet connected to the expansion device and a vapor outlet connected by a valved passageway to the evaporator.

In a second aspect, the invention is a method of making cubed ice in an ice making machine comprising the steps of: a) compressing vaporized refrigerant, cooling the compressed refrigerant to condense it into a liquid, feeding the condensed refrigerant through an expansion device and vaporizing the refrigerant in an evaporator to create freezing temperatures in an ice-forming mold to freeze water into ice in the shape of mold cavities during an ice making mode; and b) heating the ice making mold to release cubes of ice therefrom in a harvest mode by separating vaporous and liquid refrigerant within a receiver interconnected between the condenser and the expansion device and feeding the vapor from the receiver to the evaporator.

In a third aspect, the invention is an ice making apparatus in which an evaporator is located remotely from a compressor and a condenser comprising: a) a condensing unit comprising the condenser and the compressor; b) an ice making unit comprising i) a water system including a pump, an ice-forming mold and interconnecting lines therefor; and ii) a portion of a refrigeration system including the evaporator in thermal contact with the ice-forming mold, a receiver and a thermal expansion device; and c) two refrigerant lines running between the condensing unit and the ice making unit comprising a suction line and a feed line, the suction line returning refrigerant to the compressor and the feed line supplying refrigerant to the ice making unit; d) the receiver having an inlet, a liquid outlet and a vapor outlet, the inlet being connected to the feed line, the liquid outlet being connected to the expansion device, which in turn is connected to the evaporator, and the vapor outlet being connected by a valved passageway directly to the evaporator.

In a fourth aspect, the invention is an ice making machine comprising: a) a water system including a pump, an ice-forming mold and interconnecting lines therefore; and b) a refrigeration system including a compressor, a condenser, an expansion device, and evaporator in thermal contact with said ice-forming mold, and a plurality of receivers, the receivers each having an inlet connected to the condenser, a liquid outlet connected to the expansion device and a vapor outlet connected by a valved passageway to the evaporator, and a receiver equalizer line interconnecting the receivers, the pump, ice-forming mold, evaporation and receivers being contained within a cabinet having a depth, a width and a height and at least one of its depth, width or height being less than 18 inches.

In a fifth aspect, the invention is an ice making apparatus in which an evaporator is located remotely from a compressor and a condenser comprising: a) a condensing unit comprising said condenser and said compressor; b) an ice making unit comprising i) a water system including a pump, an ice-forming mold and interconnecting lines therefore; and ii) a portion of a refrigeration system including said evaporator in thermal contact with said ice-forming mold, a plurality of receivers and a thermal expansion device; and c) two refrigerant lines running between the condensing unit and the ice making unit comprising a suction line and a feed line, the suction line returning refrigerant to the compressor and the feed line supplying refrigerant to the ice making unit; wherein the receivers each have an inlet, a liquid outlet and a vapor outlet, the inlet being connected to the feed line, the liquid outlet being connected to the expansion device, which in turn is connected to the evaporator, and the vapor outlet being connected by a valved passageway directly to the evaporator, and wherein the ice making unit is contained in a cabinet having a depth of less than 18 inches.

In a sixth aspect, the invention is an ice making apparatus in which an evaporator is located remotely from a compressor and a condenser comprising: a) a condensing unit comprising said condenser and said compressor; b) an ice making unit comprising i) a cabinet having a depth of less than 18 inches; ii) a water system including a pump, an ice-forming mold and interconnecting lines therefore inside said cabinet; and iii) a portion of a refrigeration system including said evaporator in thermal contact with said ice-forming mold, at least one receiver and a thermal expansion device inside said cabinet; c) two refrigerant lines running between the condensing unit and the ice making unit comprising a suction line and a feed line, the suction line returning refrigerant to the compressor and the feed line supplying refrigerant to the ice making unit; d) wherein the at least one receiver has an inlet, a liquid outlet and a vapor outlet, the inlet being connected to the feed line, the liquid outlet being connected to the expansion device, which in turn is connected to the evaporator, and the vapor outlet being connected by a valve passageway directly to the evaporator, and further wherein the ice making unit is able to produce at least 500 pounds of ice per day under ARI standard rating conditions of 90° F. ambient temperature and 70° F. ambient inlet water temperature.

In the seventh aspect, the invention is a combination of an ice making unit and an ice and beverage dispenser comprising: a) an ice and beverage dispenser having an ice storage bin in the top thereof with a internal bin depth, and b) an ice making unit housed in a cabinet placed on top of the ice storage bin, the cabinet having a depth, the depth of the ice making unit being at least 8 inches less than the internal depth of the ice storage bin.

In an eighth aspect, the invention is a compact ice making unit comprising: a cabinet, a water system inside the cabinet, including a water pump, an ice-forming mold and interconnecting lines therefore, and a portion of a refrigeration system including an evaporator in thermal contact with the ice-forming mold, at least one receiver and a thermal expansion device, wherein the cabinet occupies a volume and wherein the ice making unit produces cubed ice at a rated capacity of 2500 pounds per day or less under ARI standard test conditions of 90° F. ambient temperature and 70° F. ambient inlet water temperature, and wherein the ratio of ice production rate to cabinet volume is at least 125 pounds of ice/day/$ft^3$.

BRIEF DESCRIPTION OF THE DRAWINGS

FIG. 30 is a cross-sectional view of the pump housing illustrated in FIG. 29*a* taken along section line 30-30.

FIG. 31 is a perspective view of the pump motor and pump housing illustrated in FIG. 29*a*.

DETAILED DESCRIPTION

Figure 1:
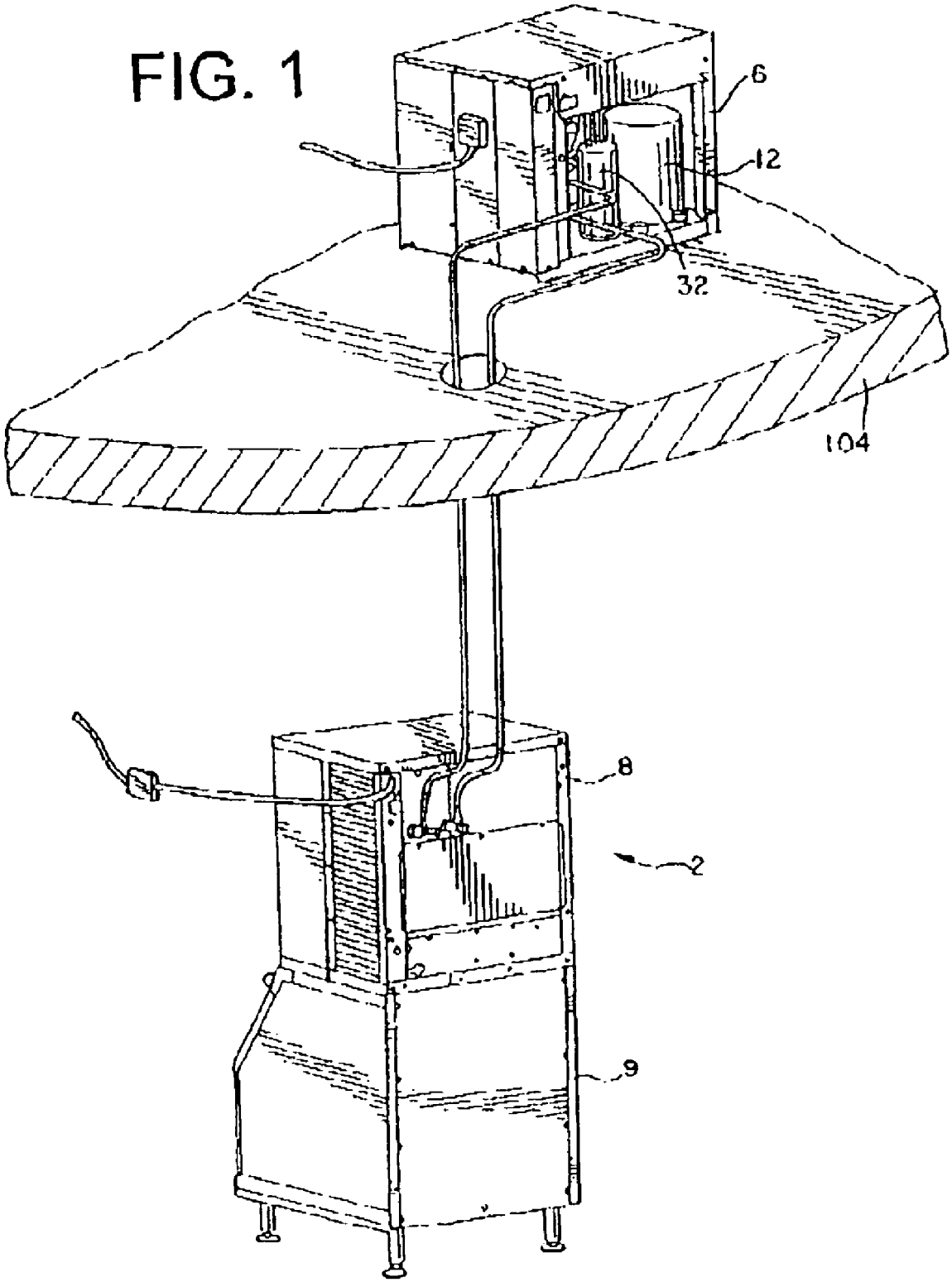
FIG. 1 is a perspective view of a remote ice machine including an ice making unit and a condensing unit, utilizing the present invention.

FIG. 1 shows the preferred embodiment of the present invention, an automatic ice making apparatus or machine 2 having a condensing unit 6 and an ice making unit 8. The condensing unit 6 contains a compressor 12 and condenser with a fan and motor and is generally mounted on the roof 104 of a building, or could be located outside on the ground or in a back room. The ice making unit 8 contains an evaporator and ice-forming mold, and is usually located in the main portion of a building. As shown, the ice making unit 8 typically sits on top of an ice storage bin 9. The present invention can also be used in ice making machines where the compressor and/or condenser are located in the same cabinetry as the evaporator/ice-forming mold. However, in such situations, hot gas defrost works well and thus the invention is more particularly suited to remote ice making equipment. Novel refrigeration systems used in ice machines of the present invention may also be useful in other equipment which include refrigeration systems.

The preferred automatic ice making machine 2 is very similar to a Manitowoc brand remote ice making machine, such as the Model QY 1094 N. Thus, many features of such a machine will not be discussed. Instead, those features by which the present invention differs will primarily be discussed. Some components, such as the compressor 12, will be discussed although there is no difference between that specific component in the Model QY 1094 N remote ice making machine and in the preferred embodiment of the invention. However, reference to these parts common to the prior art and preferred embodiment of the invention is necessary to discuss the new features of the invention.

The present invention is most concerned with the refrigeration system of the ice machine. Several different embodiments of refrigeration systems that could be used to practice the present invention will be discussed first. Thereafter, the total ice making machine will be described.

Figure 8:
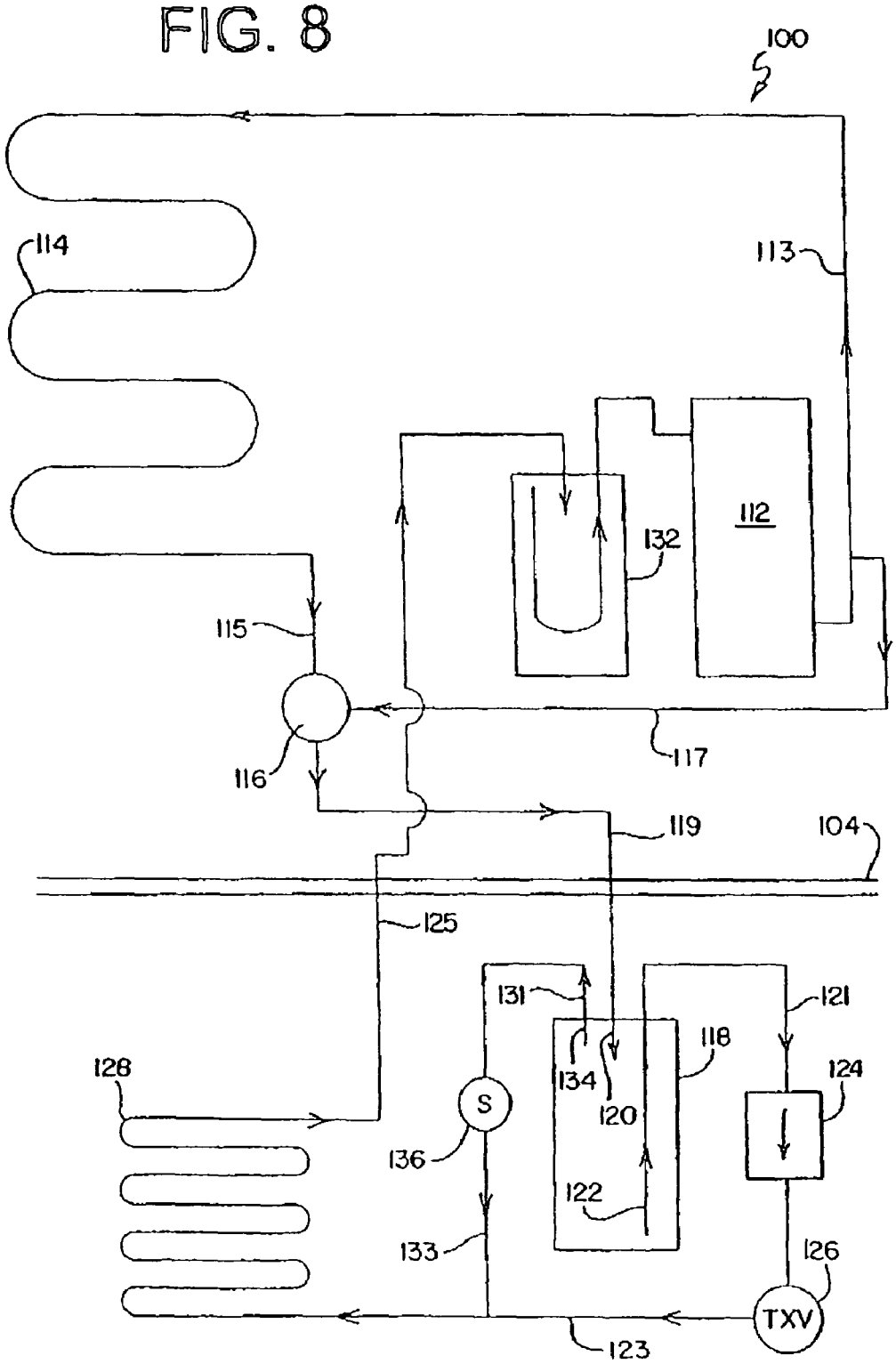
FIG. 8 is a schematic drawing of a second embodiment of a refrigeration system used in the present invention.

FIG. 8 depicts a first preferred embodiment of a refrigeration system 100 that can be used in ice machines of the present invention. The double line across the figure represents the roof 104 of FIG. 1. The system 100 includes a compressor 112 connected to a condenser 114 by refrigerant line 113. While one loop of condenser tubing is shown, it should be understood that the condenser may be constructed with any number of loops of refrigerant tubing, using conventional condenser designs. The refrigerant line 115 from the condenser is connected to head pressure control valve 116. A bypass line 117 from the compressor also feeds into the head pressure control valve, such as a Head Master brand valve. The head pressure control valve 116 is conventional, and is used to maintain sufficient head pressure in the high pressure side of the refrigeration system so that the expansion device and other components of the system operate properly. The head pressure control valve 116 and bypass line 117 are preferred for low ambient temperature operation.

The refrigerant from the head pressure control valve 116 flows into receiver 118 through refrigerant line 119 and inlet 120. Line 119 is often referred to as a feed line or liquid line. However, especially when the head pressure control valve opens, vaporous refrigerant, or both vaporous and liquid refrigerant, will flow through line 119. Liquid refrigerant is removed from the receiver 118 through a liquid outlet 122, preferably in the form of a tube extending to near the bottom of the receiver 118. Liquid refrigerant travels from the receiver 118 through outlet 122 and refrigerant line 121 through a drier 124 and an expansion device, preferably a thermal expansion valve 126. Refrigerant from the thermal expansion valve 126 flows to evaporator 128 through line 123. From the evaporator 128 the refrigerant flows through line 125 back to the compressor 112, passing through an accumulator 132 on the way. The accumulator 132, compressor 112 and evaporator 128 are also of conventional design.

A unique feature of the refrigeration system 100 is that the receiver 118 has a vapor outlet 134. This outlet is preferably a tube which extends only to a point inside near the top of the receiver. In the system 100, all of the refrigerant enters into the receiver 118. Refrigerant coming into the receiver is separated, with the liquid phase on the bottom and a vapor phase on top. The relative amounts of liquid and vapor in the receiver 118 will be dependent on a number of factors. The receiver 118 should be designed so that the outlet tubes 122 and 134 are positioned respectively in the liquid and vapor sections under all expected operating conditions. During a freeze cycle of an ice machine, the vapor remains trapped in the receiver 118. However, when the system is used during a harvest mode of an ice making machine valve 136 is opened. The passageway between the receiver 118, through vapor outlet 134 and refrigerant lines 131 and 133, to the evaporator 128, is thus opened, and the vapor outlet is connected by the valved passageway directly to the evaporator. Cool vapor, taken off the top of the receiver 118, is then passed through the evaporator, where some of it condenses. The heat given off as the refrigerant is converted to a liquid from a vapor is used to heat the evaporator 128. This results in ice being released from the evaporator in an ice machine.

The amount of vapor in the receiver at the beginning of a harvest cycle may be insufficient to warm the evaporator to a point where the ice is released. However, as vapor is removed from the receiver, some of the refrigerant in the receiver vaporizes, until the receiver gets too cold to vaporize more refrigerant. This also results in a lower pressure on the outlet, or high side, of the compressor.

When the pressure on the high side of the compressor falls below a desired point, the head pressure control valve 116 opens and hot gas from the compressor is fed to the receiver 118 through the bypass line 117 and liquid line 119. This hot vapor serves two functions. First, it helps heat the liquid in the receiver tank 118 to aid in its vaporization. Second, it serves as a source of vapor that mixes with the cold vapor to help defrost the evaporator. However, the vapor that is used to defrost the evaporator is much cooler than the hot gas directly from the compressor in a conventional hot gas defrost system.

In the past it was believed that the sensible heat from the superheated refrigerant in the "hot gas defrost" in an ice machine was needed to heat the evaporator to where it releases the ice. However, in view of the discovery of the present invention, it is appreciated that it is the latent heat from the vapor condensing in the evaporator, rather than the hot gas from the compressor, that is needed for the harvest. Thus, by using a receiver of a unique design, ample amounts of cool vapor refrigerant may be supplied to the evaporator in a harvest mode.

Figure 7:
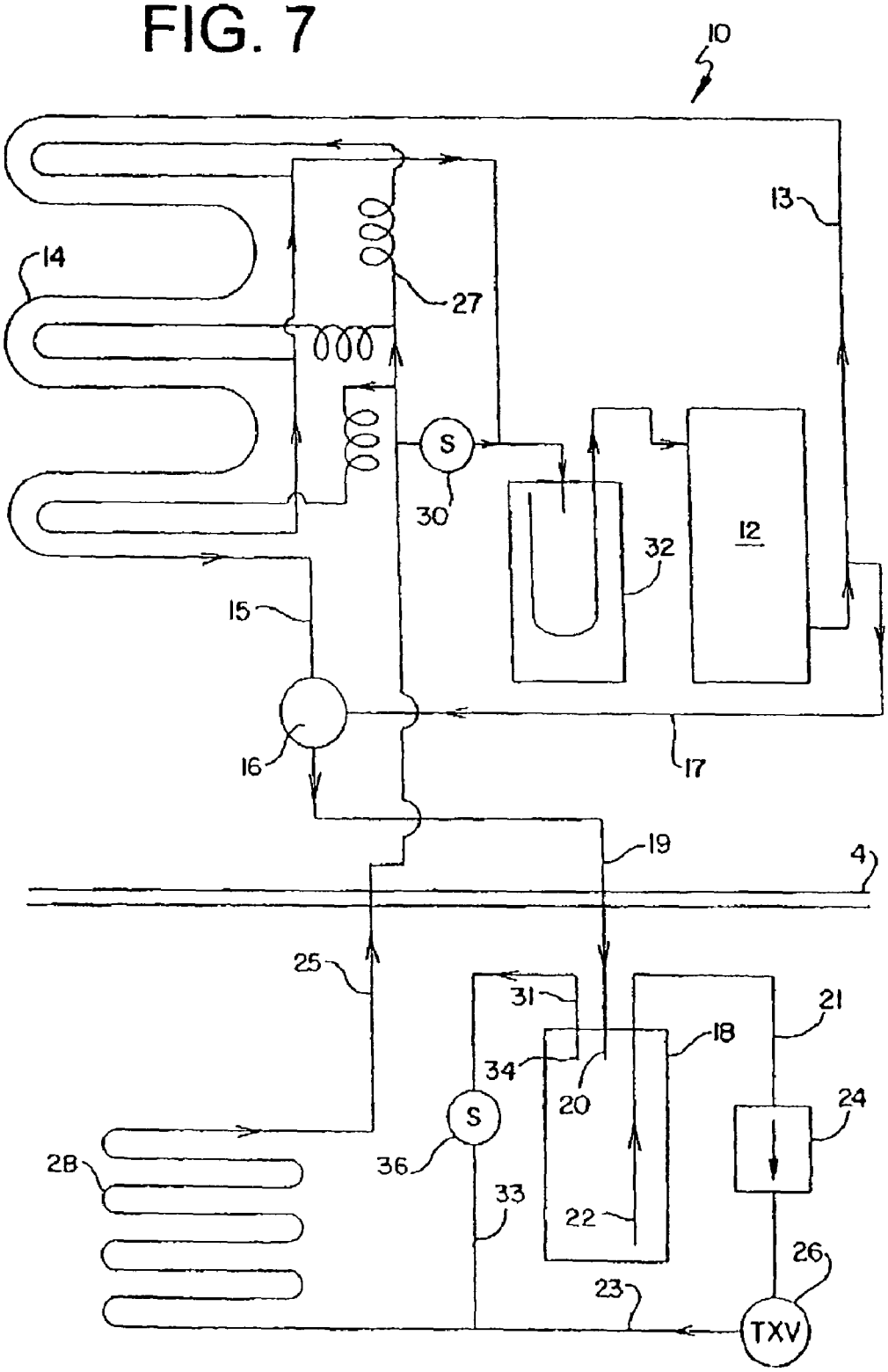
FIG. 7 is a schematic drawing of a first embodiment of a refrigeration system used in the present invention.

FIG. 7 shows a second embodiment of a refrigeration system 10, which was developed prior to the embodiment of FIG. 8. The refrigeration system 10 is just like refrigeration system 100 of FIG. 8 except that solenoid valve 30 and capillary tubes 27 were used in the system 10. The same parts have thus been numbered with the same reference numbers, with a difference of 100. If solenoid valve 30 is closed, the returning refrigerant flows through capillary tubes 27 in heat transfer relationship with the coils of condenser 14. The heat from the condenser helps to vaporize any refrigerant in liquid form returning from the evaporator. It was discovered that the solenoid valve 30 and capillary tubes 27 were unnecessary for proper operation of the refrigeration system in an automatic ice making machine, as the liquid refrigerant coming from the evaporator 128 during the harvest mode would collect in the accumulator 132.

Figure 4:
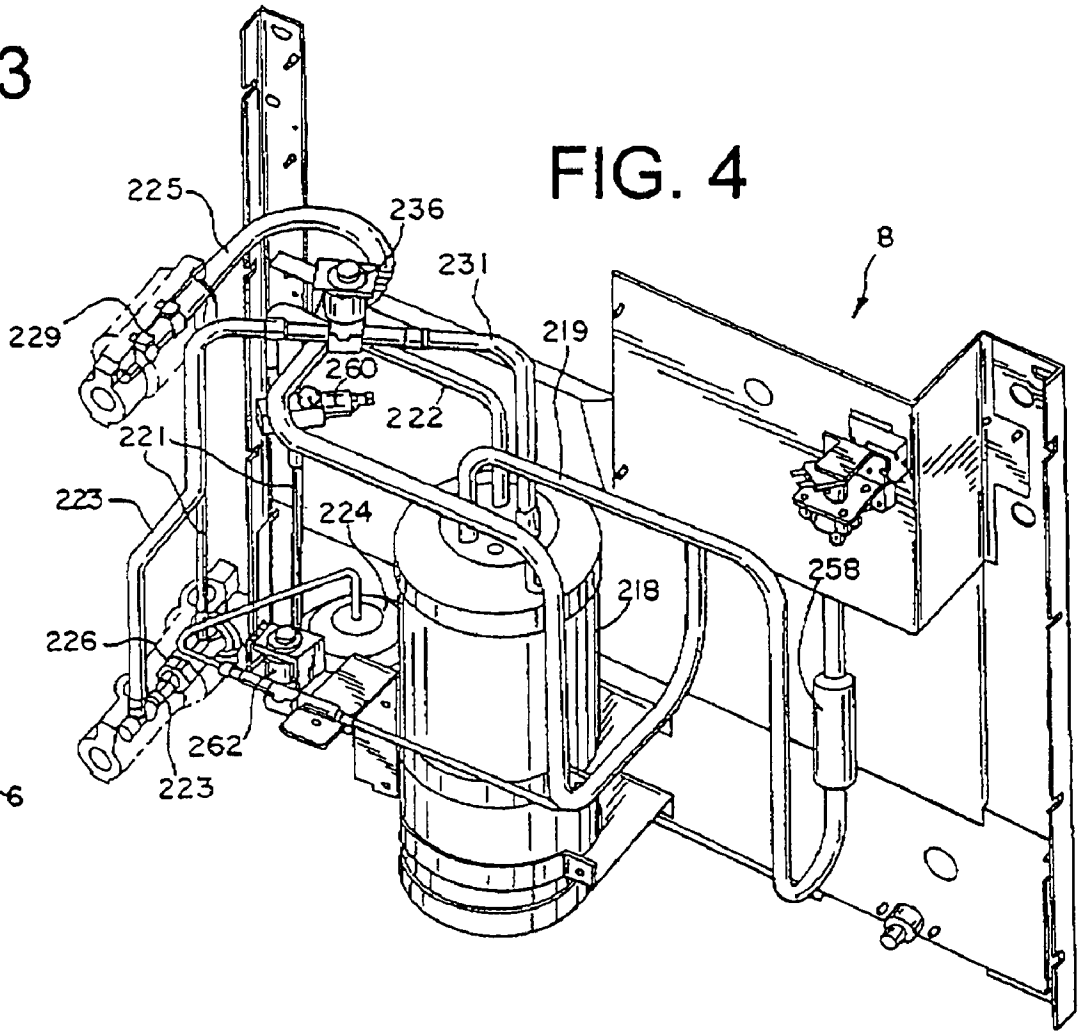
FIG. 4 is a perspective view of the back side of the ice making unit of FIG. 1.
Figure 3:
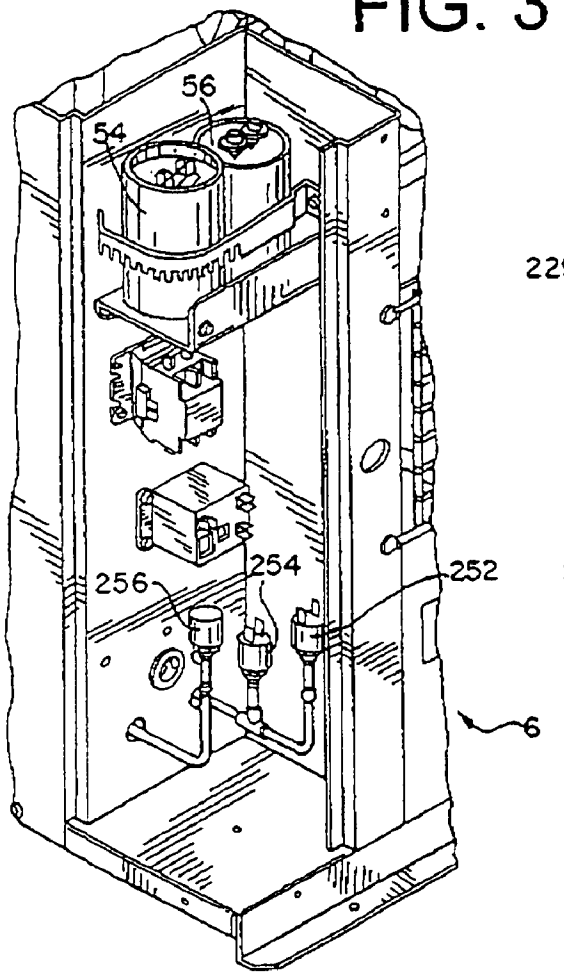
FIG. 3 is a perspective view of the electrical area of the condensing unit of FIG. 2.
Figure 9:
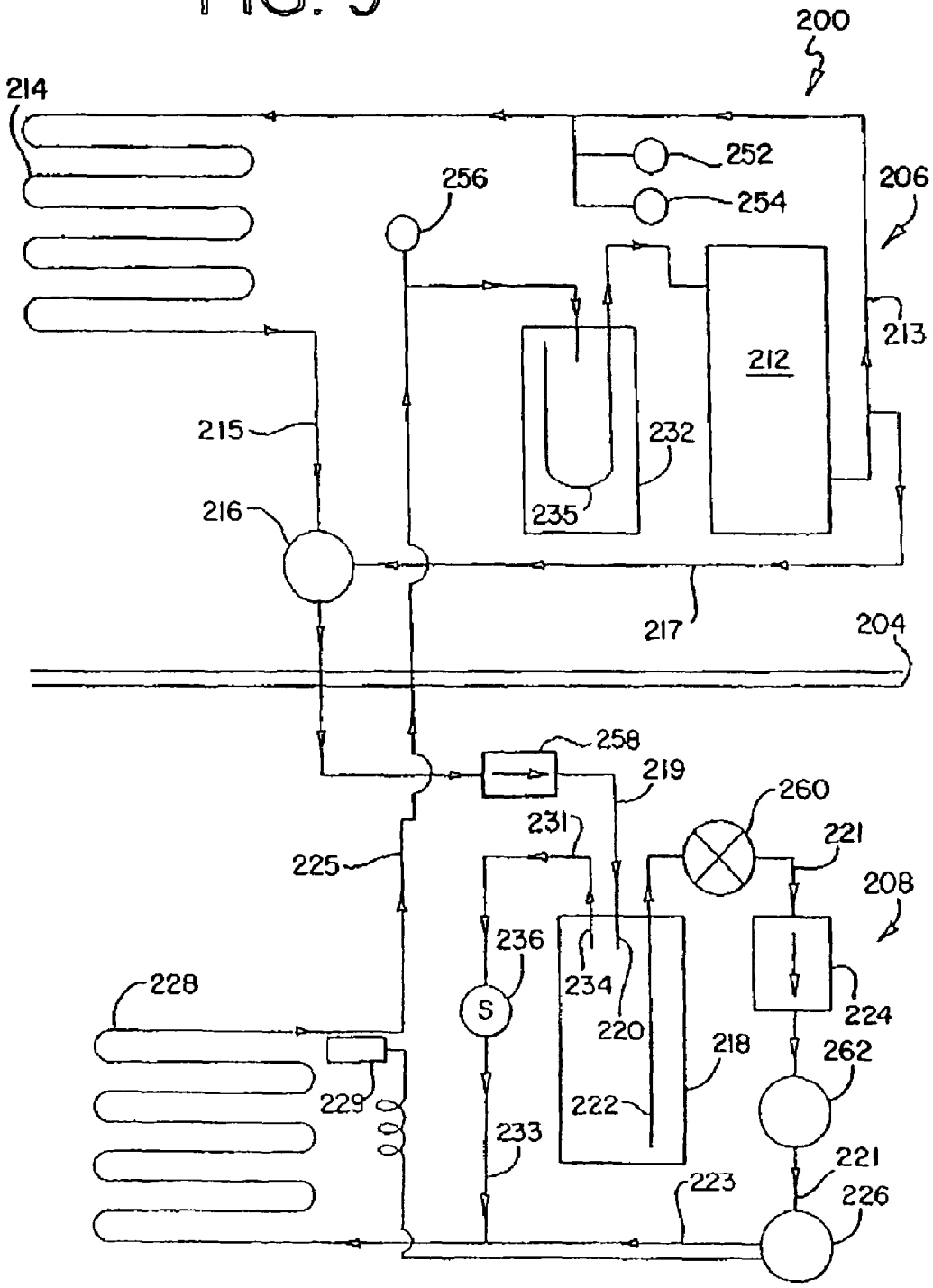
FIG. 9 is a schematic drawing of a third embodiment of a refrigeration system used in the present invention.

FIG. 9 shows a third preferred embodiment of a refrigeration system 200. This refrigeration system is particularly designed for use in an ice making apparatus where a condenser and compressor in condensing unit 206 are located remotely from an evaporator housed in an ice making unit 208. The refrigeration system 200 uses the same components as refrigeration system 100, with a few additional components. The components in system 200 that are the same as the components in system 100 have the same reference numbers, with an addend of 100. Thus, compressor 212 in system 200 may be the same as compressor 112 in system 100. System 200 includes a few more control items. For example, a fan cycling control 252 and a high pressure cut out control 254 are connected to the high pressure side of the compressor 212. A low pressure cutout control 256 is included on the suction side of the compressor 212. These items are conventional, and serve the same functions as in prior art automatic ice making machine refrigeration systems. A check valve 258 is included in the refrigerant line 219 on the inlet side of receiver 218. In addition to drier 224, a hand shut off valve 260 and a liquid line solenoid valve 262 are included in the refrigerant line from the receiver 218 to the thermal expansion valve 226. FIG. 9 also shows the capillary tube and bulb 229 connected to the outlet side of the evaporator 228 which controls thermal expansion valve 226. Not shown in FIG. 9 is the fact that the refrigerant line 221 between the liquid solenoid valve 262 and the thermal expansion valve 226 is preferably coupled in a heat exchange relationship with the refrigerant line 225 coming from the evaporator 228. This is shown in FIG. 4, however. This prechills the liquid refrigerant coming from the receiver 218, as is conventional.

The cold vapor solenoid 236 is operated just like the solenoid valve 136 to allow cool vapor from the receiver 218 to flow into the evaporator 228 during a harvest mode. The head pressure control valve 216 operates just like head pressure control valve 116 to maintain pressure in the high side of the refrigeration system 200.

The J-tube 235 in accumulator 232 preferably includes orifices near the bottom so that any oil in the refrigerant that collects in the bottom of the accumulator will be drawn into the compressor 212, as is conventional.

Sometimes ice machines are built with multiple evaporators. Where a high capacity of ice production is desired, two or more evaporators can produce larger volumes of ice. One evaporator twice as large would conceivably also produce twice the ice, but manufacturing such a large evaporator may not be practicable. The present invention can be used with multiple evaporators.

Figure 10:
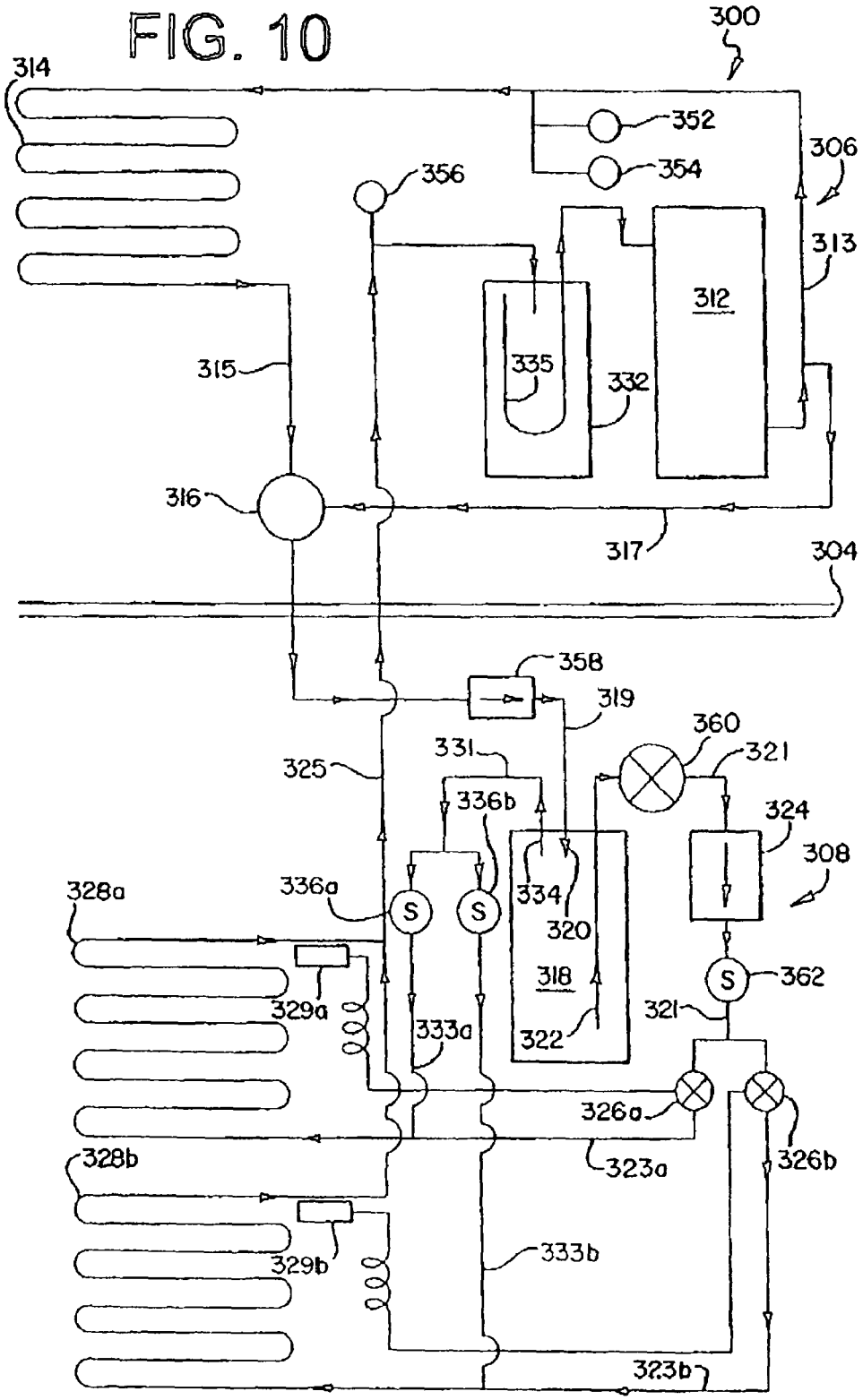
FIG. 10 is a schematic drawing of a refrigeration system used in a dual-evaporator embodiment of the present invention.

FIG. 10 shows a fourth preferred embodiment of a refrigeration system 300 where the ice machine has two evaporators 328*a* and 328*b*. The refrigeration system 300 is just like refrigeration system 200 except some parts are duplicated, as described below. Therefore, reference numbers in FIG. 10 have an addend of 100 compared to the reference numbers in FIG. 9.

Two thermal expansion valves 326*a* and 326*b* are used, feeding liquid refrigerant through lines 323*a* and 323*b* to evaporators 328*a* and 328*b*, respectively. Each is equipped with its own capillary tube and sensing bulb 329*a* and 329*b*. Likewise, two solenoid valves 336*a* and 336*b* are used to control the flow of cool vapor to evaporators 328*a* and 328*b* through lines 333*a* and 333*b*. This allows the two evaporators to each operate at maximum efficiency, and freeze ice at their own independent rate. Of course it is possible to use one thermal expansion valve, but then, because it would be very difficult to balance the demand for refrigerant in each evaporator, one evaporator (the lagging evaporator) would not be full when it was time to defrost the other evaporator.

Having two separate solenoid valves 336*a* and 336*b* allows one valve to be closed once ice has been harvested from the associated evaporator. When it is time to harvest, solenoid valves 336*a* and 336*b* will open, and cool vapor from receiver 318 will be permitted to flow into lines 333*a* and 333*b* and into evaporators 328*a* and 328*b*. Both evaporators go into harvest at the same time. However, once ice falls from evaporator 328*a*, the valve 336*a* will shut, and evaporator 328*a* will be idle while evaporator 328*b* finishes harvesting. With valve 336*a* shut, cool vapor is not wasted in further heating evaporator 328*a*, but rather is all used to defrost evaporator 328*b*. Of course, the reverse is also true if evaporator 328*b* harvests first.

Figure 6A:
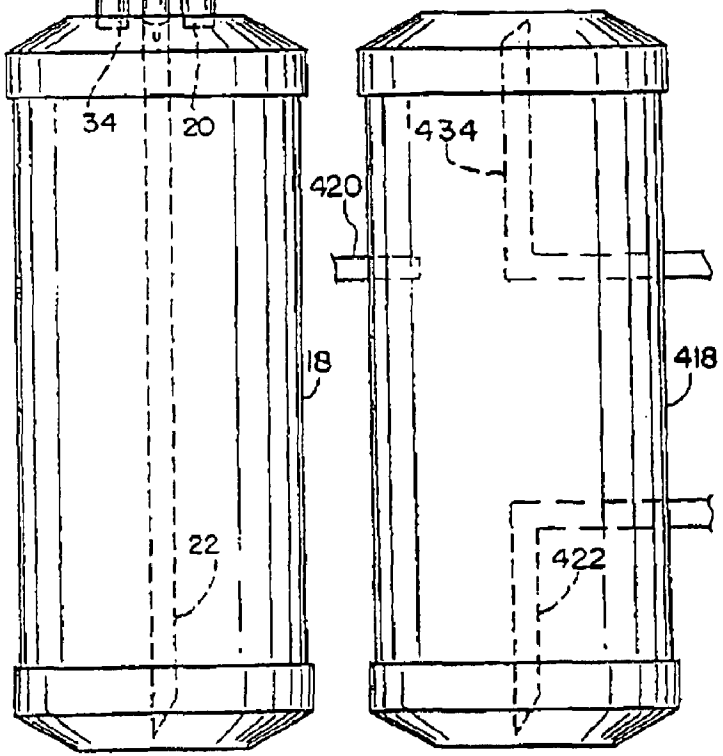
FIG. 6A is a schematic diagram of an alternate receiver for use in the invention.
Figure 6:
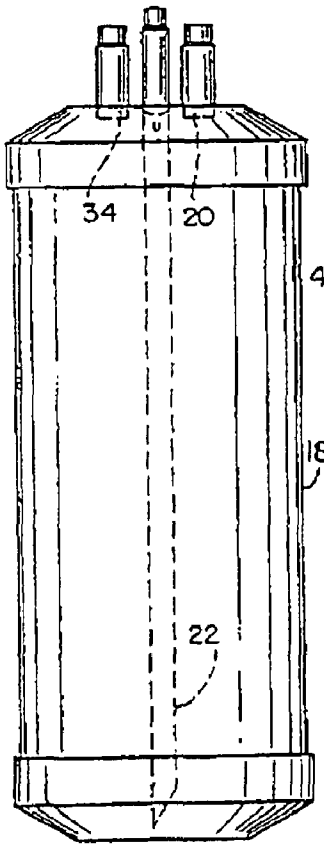
FIG. 6 is an elevational view of the receiver used in the ice making machine of FIG. 1.

The receiver of the present invention must be able to separate liquid and vaporous refrigerant, and have a separate outlet for each. The vapor drawn off of the receiver will not normally be at saturation conditions, especially when the head pressure control valve is opened, because heat and mass transfer between the liquid and vapor in the receiver is fairly limited. In the preferred embodiment, the receiver 18 (FIG. 6) is generally cylindrical in shape, and is positioned so that the wall of the cylinder is vertical when in use (FIG. 4). Preferably, all of the inlet and outlet connections pass through the top of the receiver. This allows the receiver to be constructed with only one part that need holes in it, and the holes can all be punched in one punching operation to minimize cost. The inlet tube 20 can terminate anywhere in the receiver, but preferably terminates near the top. The liquid outlet 22 terminates near the bottom, and the vapor outlet 34 terminates near the top. Thus it is most practical to have all three tubes pass through the top end panel of the cylinder. Of course other receiver designs can be used, as long as cool vapor can be drawn from the receiver to feed the evaporator during harvest or defrost modes. FIG. 6A shows another receiver 418 where inlet 420 is mounted in the sidewall of the receiver 418. The liquid outlet 422 also exits through the side wall of the receiver, but has a dip tube at a 90° bend so that the end of the outlet tube 422 is near the bottom of the receiver 418. Similarly, vapor outlet 434 is mounted in the side but has an upturned end so that cool vapor from near the top of the receiver 418 will be drawn off.

The head pressure control valve performs two functions in the preferred embodiment of the invention. During the freeze mode, especially at low ambient temperatures, it maintains minimum operating pressure. During the harvest mode, it provides a bypass. If no head pressure control valve were used, the harvest cycle would take longer, more refrigerant would be needed in the system, and the receiver would get cold and sweat. Instead of a head pressure control valve, line 217 could join directly into line 215 and a second solenoid valve could be used in line 217 (FIG. 9) to allow compressed refrigerant from the compressor to go directly to the receiver 218. However, then the electrical controls would require wiring to run between the condensing unit 206 (comprising the compressor and condenser) and the ice making unit 208 (comprising the evaporator and the receiver). With the preferred design of FIG. 9, those two sections can be separated by a roof 204 or wall and a great distance, and only two refrigerant lines need to run between the sections. Thus the ice making unit 208 can be located inside of a building, even close to where customers may want to receive ice cubes, and the compressor and condenser can be located outdoors, where the heat and noise associated with them will not disturb occupants of the building.

The refrigeration system of FIG. 9 can be used with the other components of a typical remote ice making machine with little change. For example, the control board for an electronically controlled remote ice making machine can be used to operate an ice making machine using the refrigeration system of FIG. 9. Instead of the control board signaling the opening of a hot gas defrost valve at the beginning of a harvest cycle, the same signal can be used to open solenoid valve 236. However, compared to the typical remote ice making machine, the compressor can now be located outdoors with the condenser.

The other components of the ice making machine can be conventional. For example, the ice machine will normally include a water system (FIG. 5) comprising a water pump 42, a water distributor 44, an ice-forming mold 46 and interconnecting water lines 48. The ice forming mold 46 is typically made from a pan with dividers in it defining separate ice cube compartments and the evaporation coil is secured to the back of the pan. The ice machine can also include a cleaning system and electronic controls as disclosed in U.S. Pat. No. 5,289,691, or other components of ice machines disclosed in U.S. Pat. Nos. 5,193,357; 5,140,831; 5,014,523; 4,898,002; 4,785,641; 4,767,286; 4,550,572; and 4,480,441, each of which is hereby incorporated by reference. For example, a soft plug is often included in a refrigeration system so that if the ice machine is in a fire, the plug will melt before any of the refrigeration system components explode.

Figure 2:
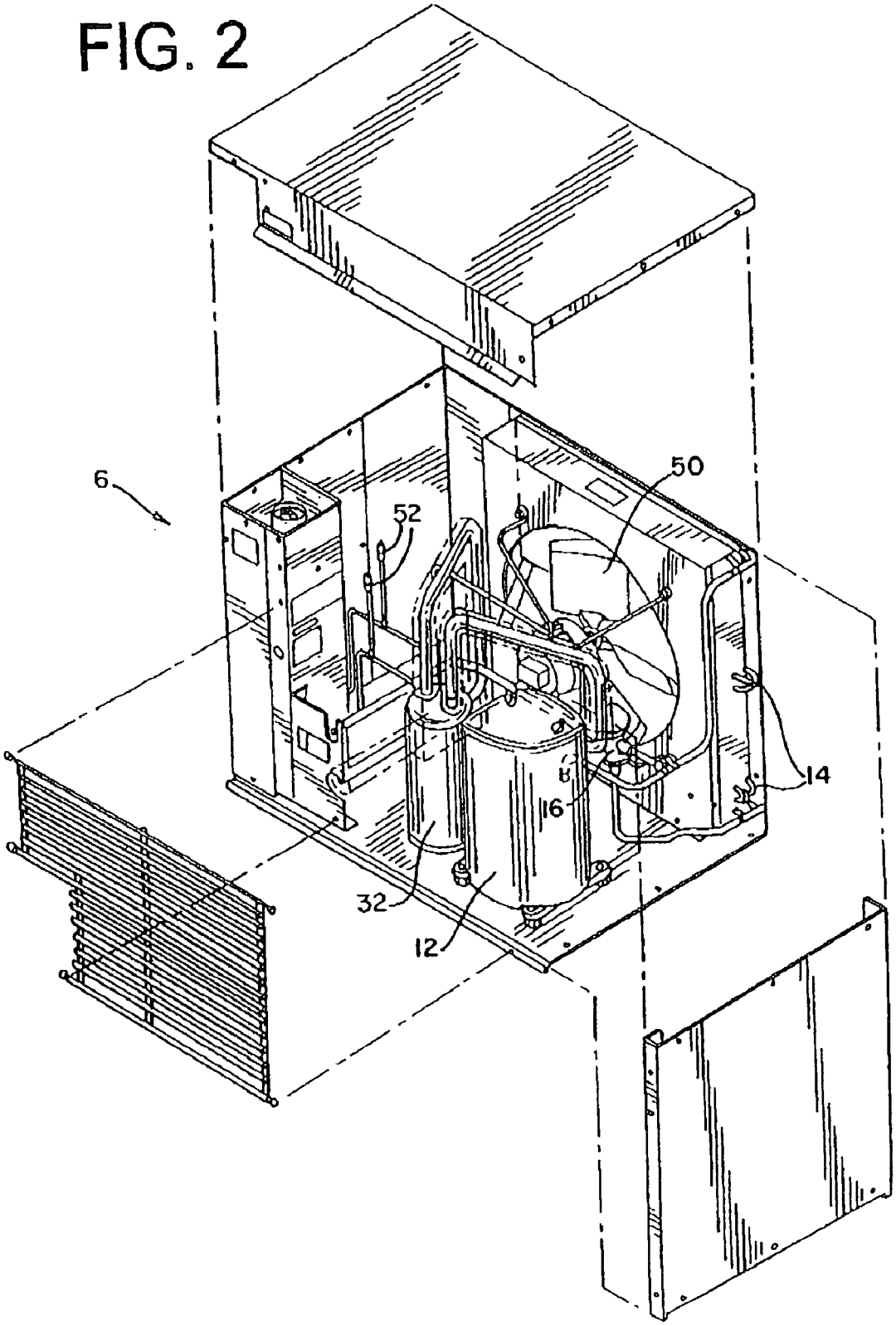
FIG. 2 is an exploded view of the condensing unit of FIG. 1.

Typical components in the condensing unit 6 are shown in FIG. 2. Beside the compressor 12 and condenser 14, which is made of serpentine tubing (only the bends of which can be seen), the condensing unit will also include a condenser fan 50 and motor, access valves 52, the head pressure control valve 16 and the accumulator 32. Electrical components, such as a compressor start capacitor 54, run capacitor 56, relays, the fan cycling control 252, the high pressure cutout control 254, and the low pressure cutout control 256 are typically contained in an electrical section in one corner of the condensing unit 6.

Figure 5:
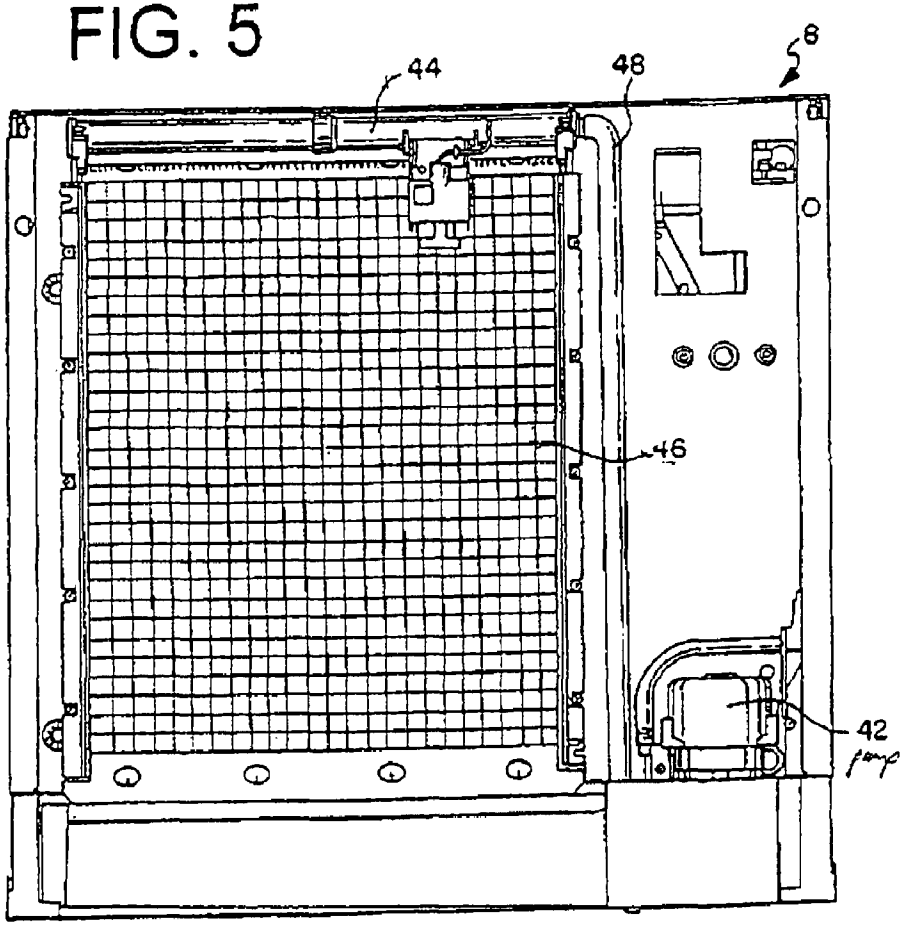
FIG. 5 is a front elevational view of the ice making unit of FIG. 4.

The ice making unit 8 holds the portion of the refrigeration system shown in FIG. 4 as well as the water system shown in FIG. 5. In this instance, the components from refrigeration system 200 are depicted as being in the ice making unit 8. However, the refrigeration system 10 or the refrigeration system 100 could also be used. Besides the evaporator 228 and receiver 218, the ice making unit 8 preferably also includes the drier 224, liquid solenoid valve 262, check valve 258, solenoid valve 236 and thermal expansion valve 226. Because the receiver 218 is preferably built into the same cabinet as the evaporator 228, it will normally be in room temperature ambient conditions. As a result, the receiver is kept fairly warm, which helps provide sufficient vapor to harvest the ice.

Figure 11:
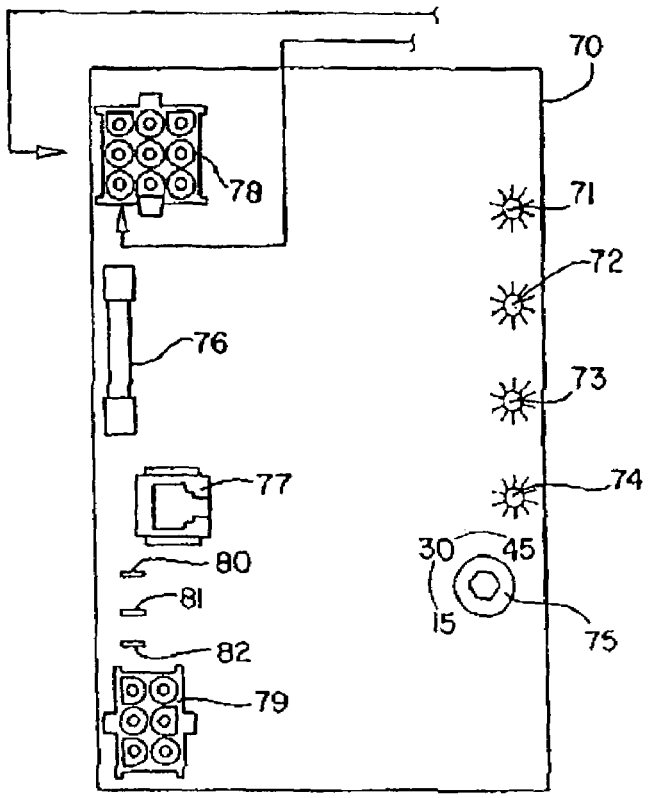
FIG. 11 is a schematic drawing showing the location of various components on the control board used in the ice making machine of FIG. 1.

FIG. 11 depicts a control board 70 for use with the ice machine 2. The elements on the control board can preferably be the same as the elements on a control board for the Model QY 1094 N remote ice machine from Manitowoc Ice, Inc. Lights 71, 72, 73 and 74 indicate, respectively, whether the machine is in a cleaning mode, if the water level is low, whether the ice bin is full, and whether the machine is in a harvest mode. There is also a timing adjustment 75 for a water purge that occurs between each freezing cycle. The control system fuse 76 and automatic cleaning system accessory plug 77 are also found on the control board, as are the AC line voltage electrical plug 78 and DC low voltage electrical plug 79. The control board also includes spade terminations 80, 81 and 82 respectively for an ice thickness probe, water level probe and an extra ground wire for a cleaning system.

Figure 12:
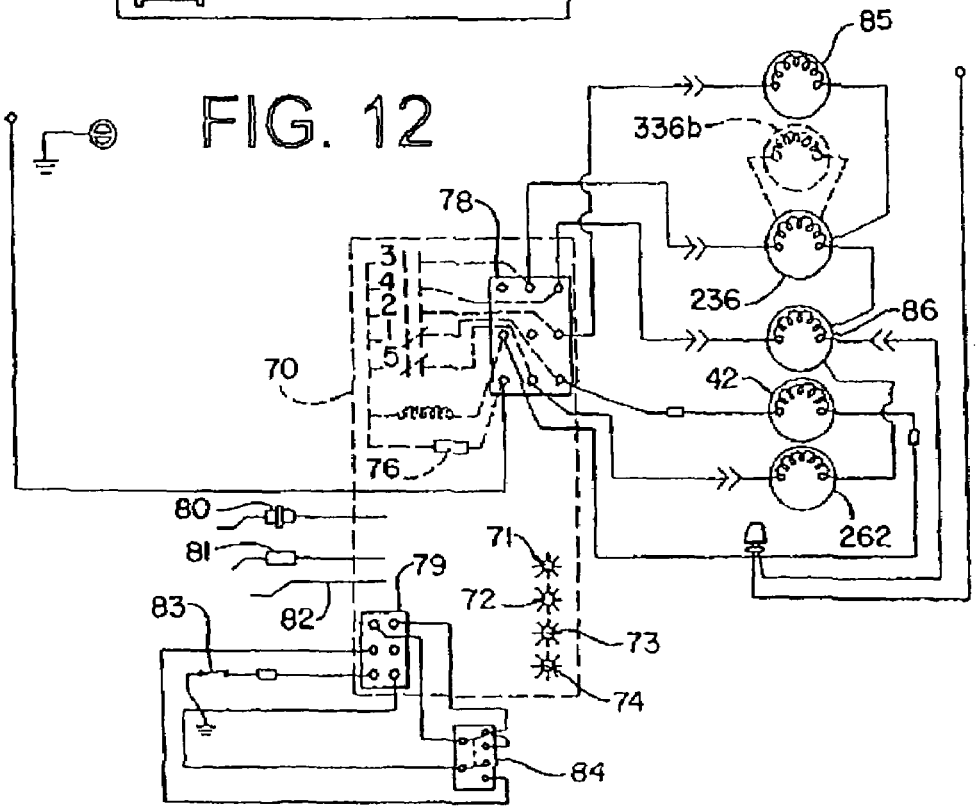
FIG. 12 is a wiring diagram for the ice making unit of FIG. 4.

FIG. 12 is a wiring diagram for the ice making unit 8. In addition to the control board 70 and many of its components, FIG. 12 shows wiring for a bin switch 83 and an internal working view of the cleaning selector toggle switch 84 for which the top position is for normal ice making operation, the middle position is the off position and the bottom position is the cleaning mode. FIG. 12 also shows the wiring for a water valve 85, cool vapor solenoid valve 236 (and in dotted lines, the second valve 336*b* when dual evaporators are used), a water dump solenoid 86, the water pump 42, and the liquid line solenoid valve 262.

Figure 13:
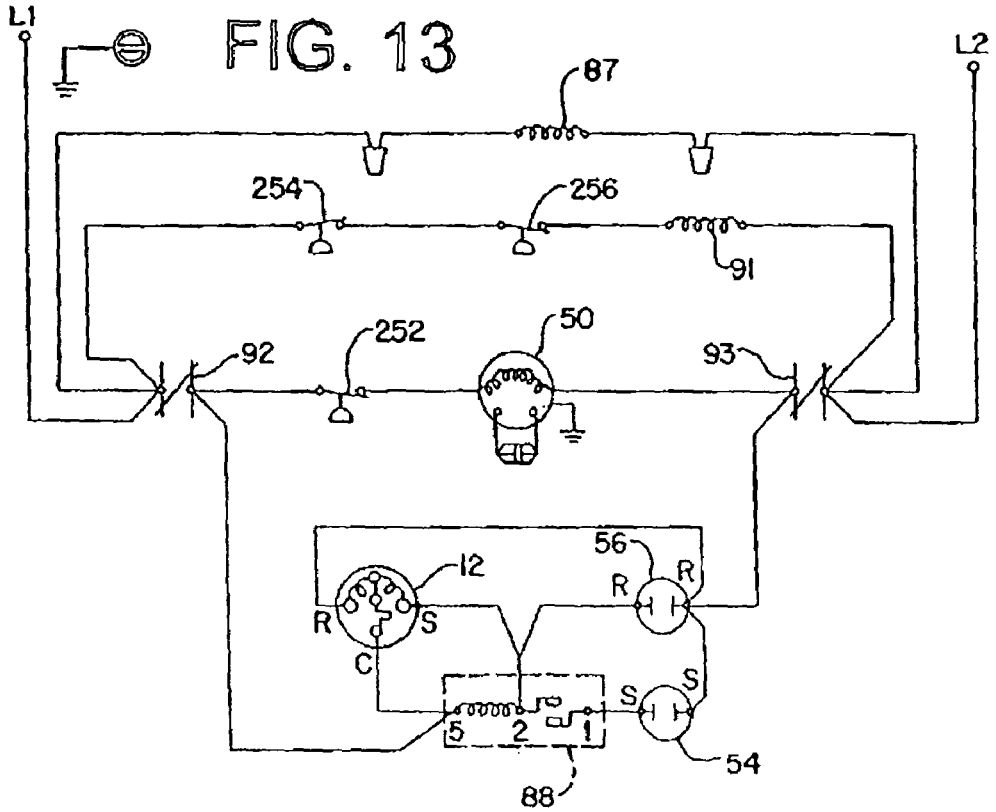
FIG. 13 is a wiring diagram for the condensing unit of FIG. 2 using single phase AC current.

FIG. 13 is a wiring diagram, showing the circuits during the freeze cycle, for the condensing unit 6 using 230V single phase alternating current. The compressor 12 main motor is shown, along with a crank case heater 87. The high pressure cut out 254, low pressure cut out 256, fan cycle control 252 and condenser fan motor 50 with a built in run capacitor are also shown, along with the compressor run capacitor 56 and start capacitor 54. A relay 88, a contactor coil 91 and contactor contacts 92 and 93 are also shown.

Figure 14:
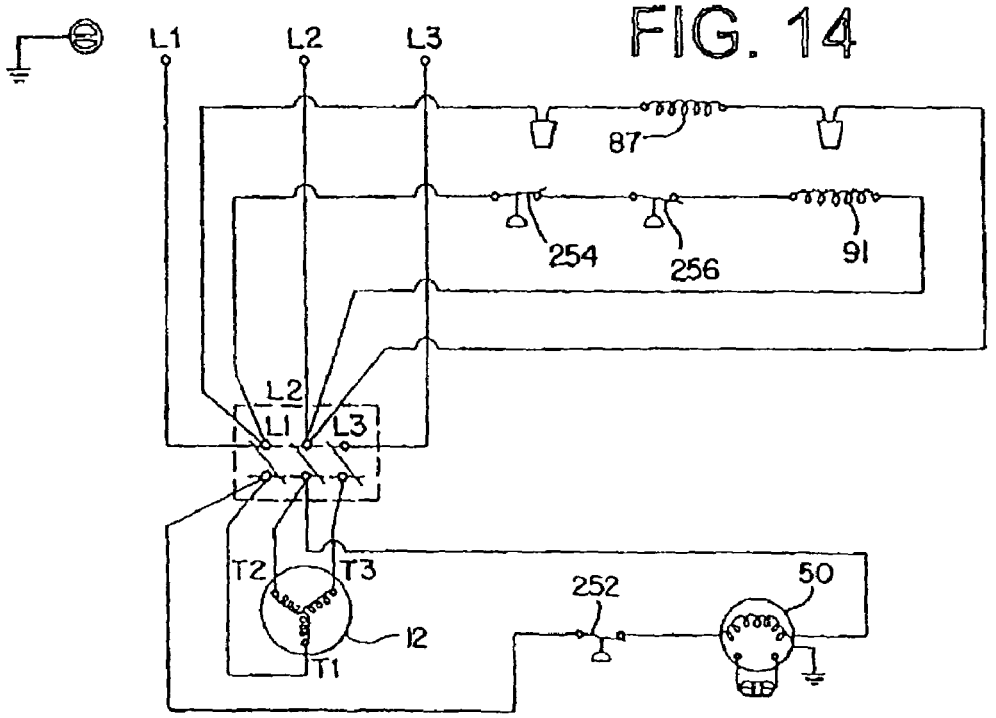
FIG. 14 is a wiring diagram for the condensing unit of FIG. 2 using three phase AC current.

FIG. 14 is a wiring diagram, again showing connections during the freeze cycle, for the condensing unit 6 using 230V three phase alternating current. Components that are the same as those in FIG. 13 have the same reference numbers.

As noted above, there is no need to run electrical wire between the condensing unit 6 and the ice making unit 8. The ice making unit 8 preferably operates off of a standard wall outlet circuit, whereas higher voltage will normally be supplied to the condensing unit 6.

The present invention allows for the compressor and condenser to be located remotely, so that noise and heat are taken out of the environment where employees or customers use the ice. However, the evaporator harvests using refrigerant. Test results show that these improvements are obtained without loss of ice capacity, with comparable harvest time and comparable energy efficiency. Further, since hot gas defrost is eliminated, the compressor is stressed less during the harvest cycle, which is expected to improve compressor life. Only two refrigerant lines are needed, because any hot gas from the head pressure control valve can be pushed down the liquid line with liquid refrigerant from the condenser, and then separated later in the receiver.

Preferably the refrigeration system uses an extra large accumulator directly before the compressor that separates out any liquid refrigerant returned during the harvest cycle. Vapor refrigerant passes through the accumulator. Liquid refrigerant is trapped and metered back at a controlled rate through the beginning of the next freeze cycle.

The compressor preferably pumps down all the refrigerant into the "high side" of the system (condenser and receiver) so no liquid can get into the compressor crank case during an off cycle. A magnetic check valve is preferably used to prevent high side refrigerant migration during off cycles. The crank case heaters prevent refrigerant condensation in the compressor crank case during off periods at low ambient temperatures.

Commercial remote embodiments of the invention are designed to work in ambient conditions in the range of −20 to 130° F. Preferably the ice making unit is precharged with refrigerant and when the line sets are installed, a vacuum is pulled after the lines are brazed in, and then evacuation valves are opened and refrigerant in the receiver is released into the system. The size of the various refrigerant lines will preferably be in accordance with industry standards. Also, as is common, the accumulator will preferably include an orifice.

The preferred amount of refrigerant in the system will depend on a number of factors, but can be determined by routine experimentation, as is standard practice in the industry. The minimum head pressure should be chosen so as to optimize system performance, balancing the freeze and harvest cycles. The size of orifice in the accumulator should also be selected to maximize performance while taking into account critical temperatures and protection for the compressor. These and other aspects of the invention will be well understood by one of ordinary skill in the art.

It should be appreciated that the systems and methods of the present invention are capable of being incorporated in the form of a variety of embodiments, only a few of which have been illustrated and described above. The invention may be embodied in other forms without departing from its spirit or essential characteristics. For example, rather than using an ice-forming evaporator made from dividers mounted in a pan with evaporator coils on the back, other types of evaporators could be used. Also, instead of water flowing down over a vertical evaporator plate, ice could be formed by spraying water onto a horizontal ice-forming evaporator.

While the ice machine of the preferred embodiment has been described with single components, some ice machines may have multiple components, such as two water pumps, or two compressors. Further, two completely independent refrigeration systems can be housed in a single cabinet, such as where a single fan is used to cool two separate but intertwined condenser coils. While not preferred, a system could be built where one compressor supplied two independently operated evaporators, where extra check valves and other controls were used so that one evaporator could be in a defrost mode while the other evaporator was in a freeze mode.

Figure 15:
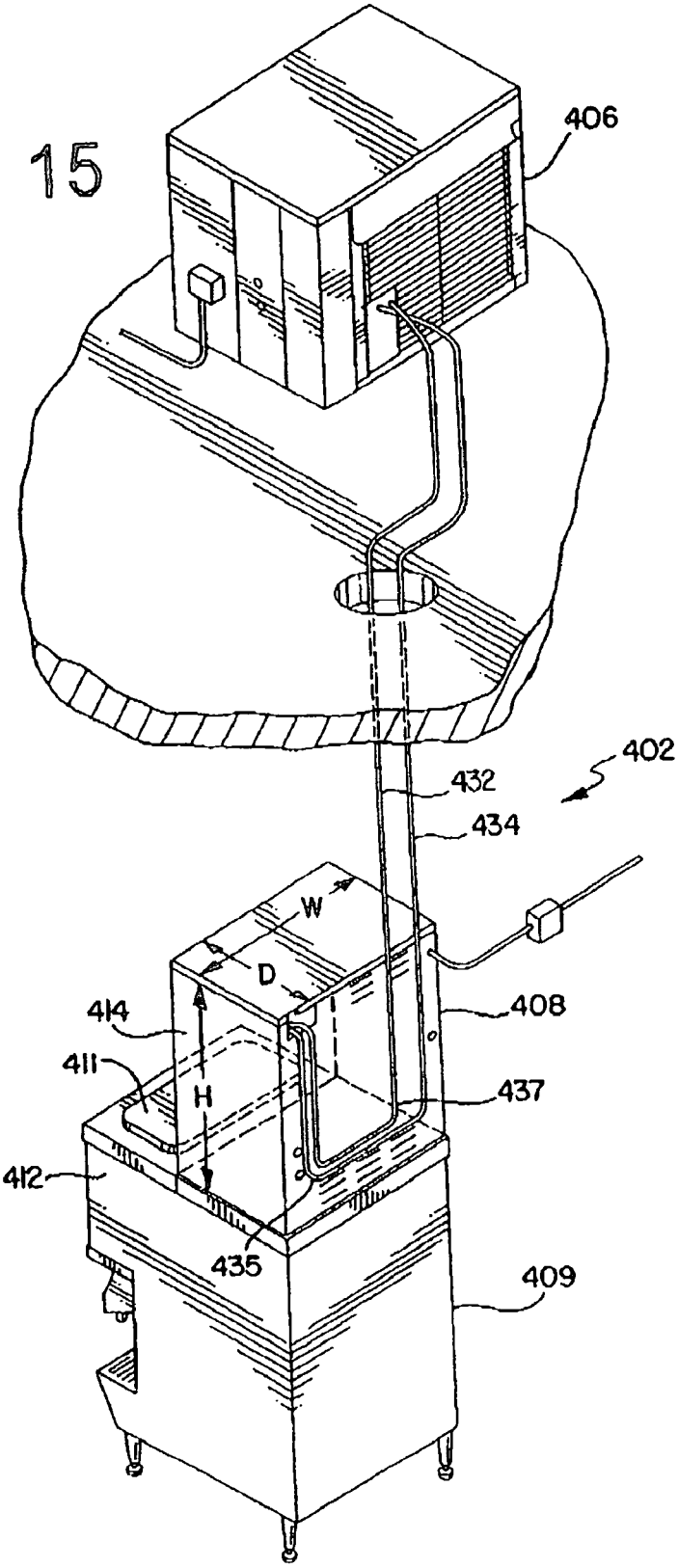
FIG. 15 is a perspective view of a second remote ice machine including a compact ice making unit and a condensing unit, utilizing the present invention.
Figure 16:
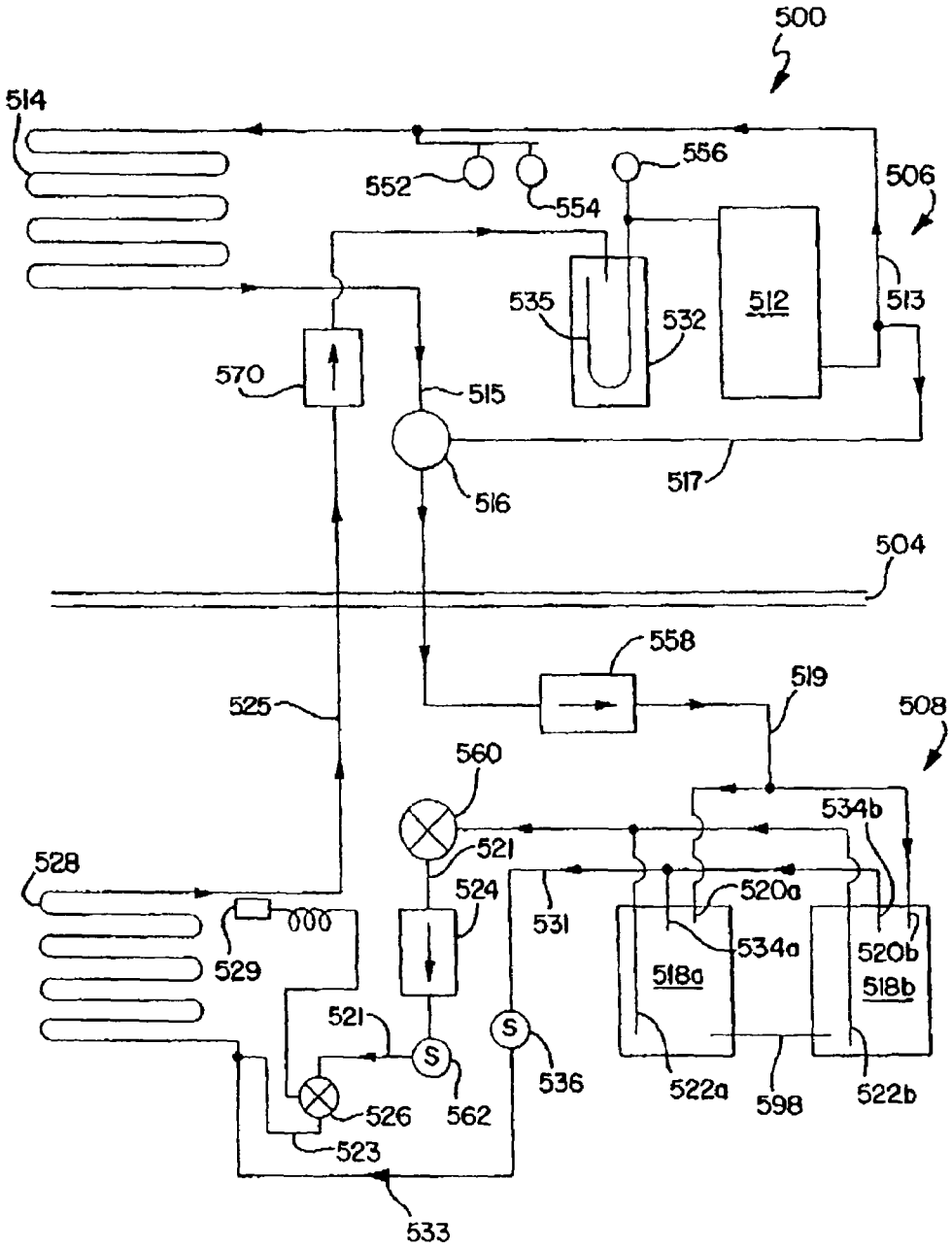
FIG. 16 is a schematic drawing of a fifth refrigeration system used in the present invention, and particularly for the ice machine of FIG. 15 using two interconnected receivers.

FIG. 15 shows a second preferred embodiment of the present invention, an automatic ice making apparatus or machine 402 having a condensing unit 406 and an ice making unit 408. The condensing unit 406 is just like the condensing unit 6 of FIG. 1, and need not be further discussed. The ice making unit 408 is more compact than the ice making unit 8 of FIG. 1, and is shown sitting on top of an ice and beverage dispenser 409. The ice and beverage dispenser 409 has an ice storage bin 412 in the top portion thereof.

Figure 20:
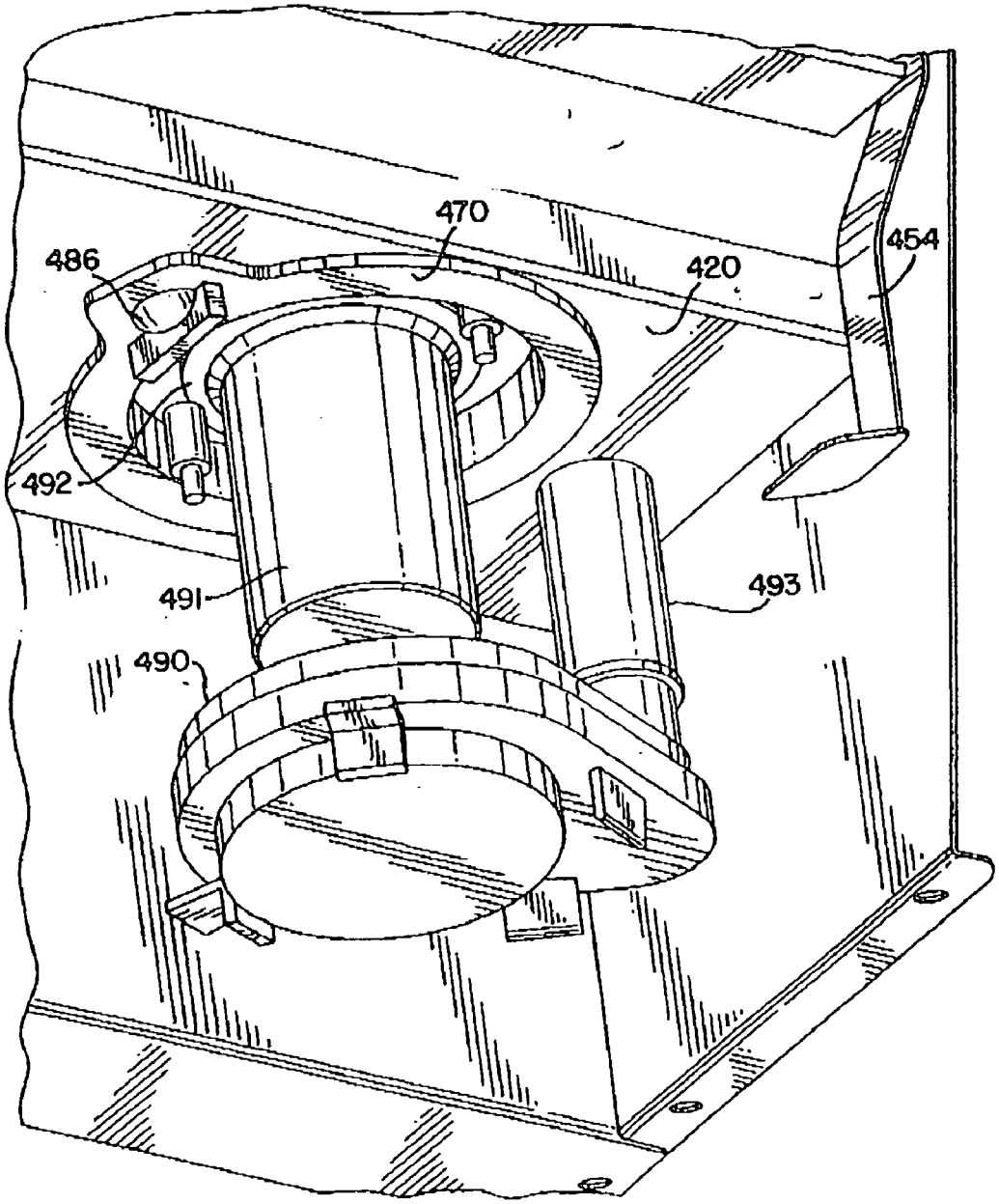
FIG. 20 is a perspective view of the water pump housing mounted in the water reservoir of the ice making unit of FIG. 15.
Figure 21:
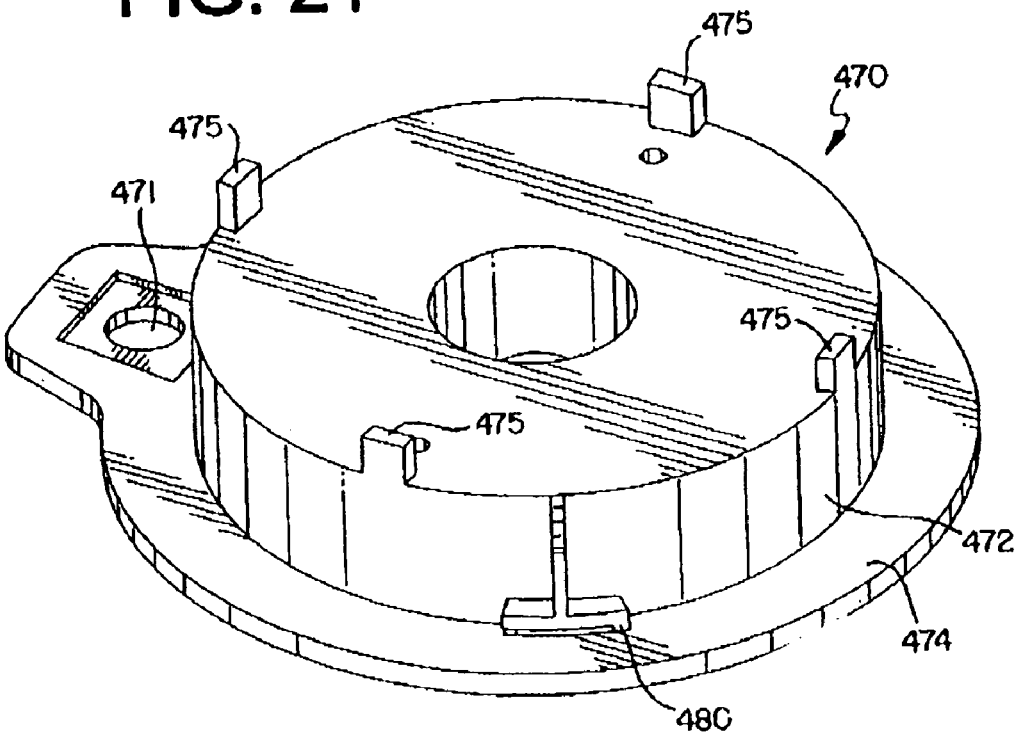
FIG. 21 is a top perspective view of an adapter for fitting the water pump into the ice making unit of FIG. 15.
Figure 22:
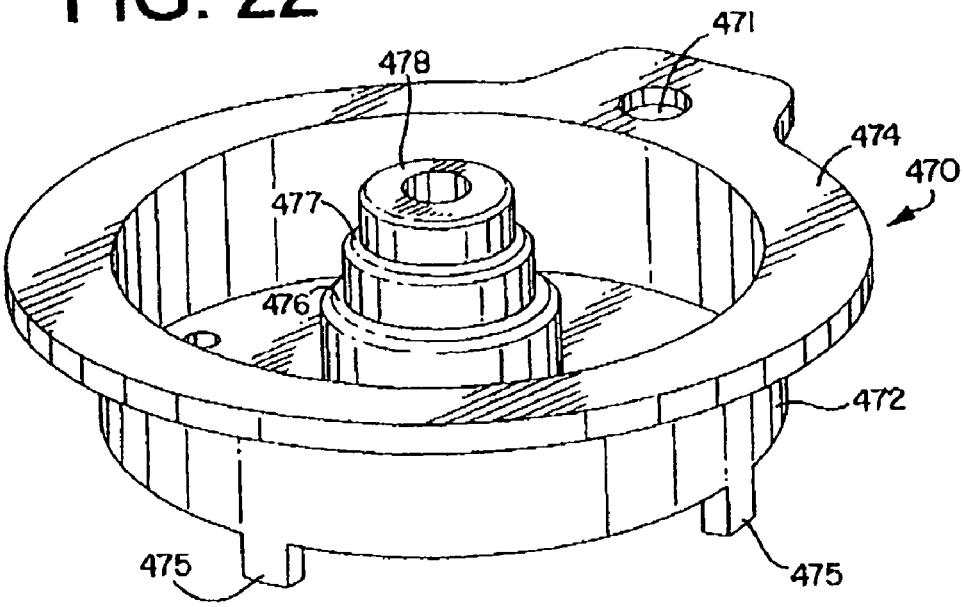
FIG. 22 is a bottom perspective view of the adapter of FIG. 21.
Figure 23:
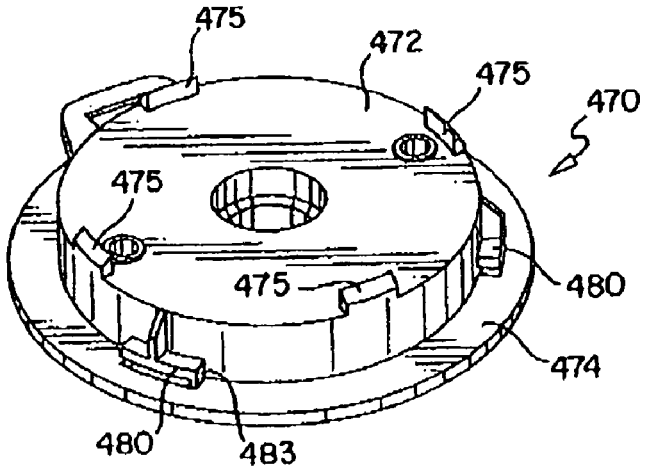
FIG. 23 is another top perspective view of the adapter of FIG. 21.
Figure 24:
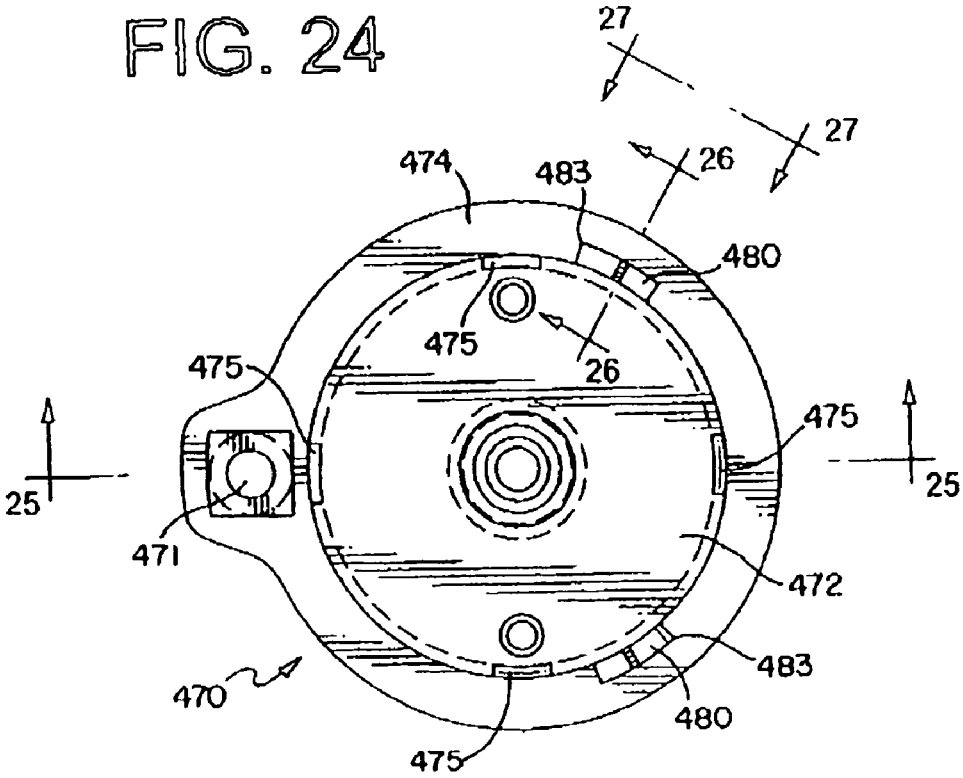
FIG. 24 is a top plan view of the adapter of FIG. 21.
Figure 25:
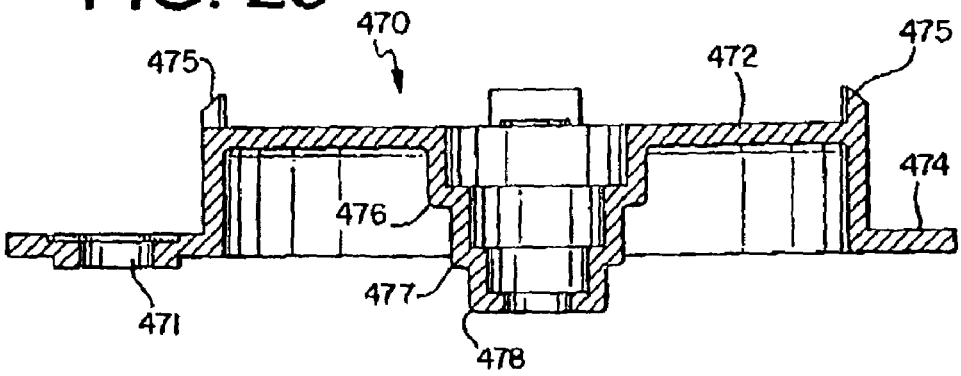
FIG. 25 is a cross-sectional view taken along line 25-25 of FIG. 24.
Figure 26:
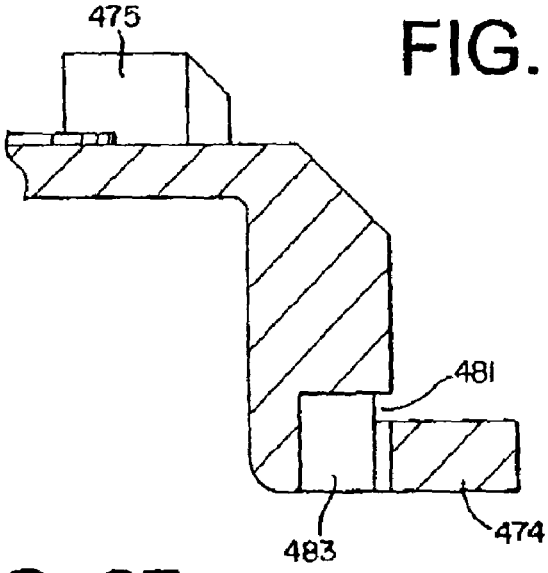
FIG. 26 is a cross-sectional view taken along line 26-26 of FIG. 24.
Figure 27:
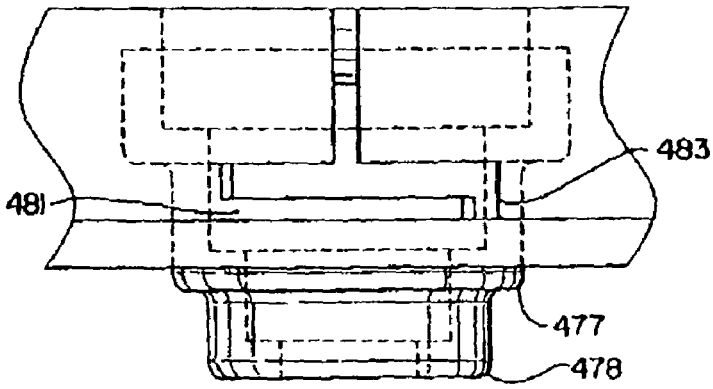
FIG. 27 is a partial side view taken along line 27-27 of FIG. 24.

One reason that the ice making unit 408 is compact is that the compressor, normally contained in the cabinet of an ice making unit in a remote system, is housed in the condensing unit 406, as explained previously. Another reason the ice making unit 408 is compact is because it uses a plurality of receivers interconnected with a receiver equalizer line, as shown in portion of the water reservoir or sump. The base 420 thus serves as a divider between the machine compartment and the water compartment. FIG. 20 shows the pump housing extending downwardly into the reservoir area of the ice making unit, but the reservoir is not included for sake of clarity. A water level sensor 454 also hangs down into the sump area. The hose 493 includes a T-fitting with an outlet 494 (FIG. 17) to a drain line that is preferably fitted with a solenoid dump valve (not shown). The adapter 470 will be explained in more detail below.

Figure 17:
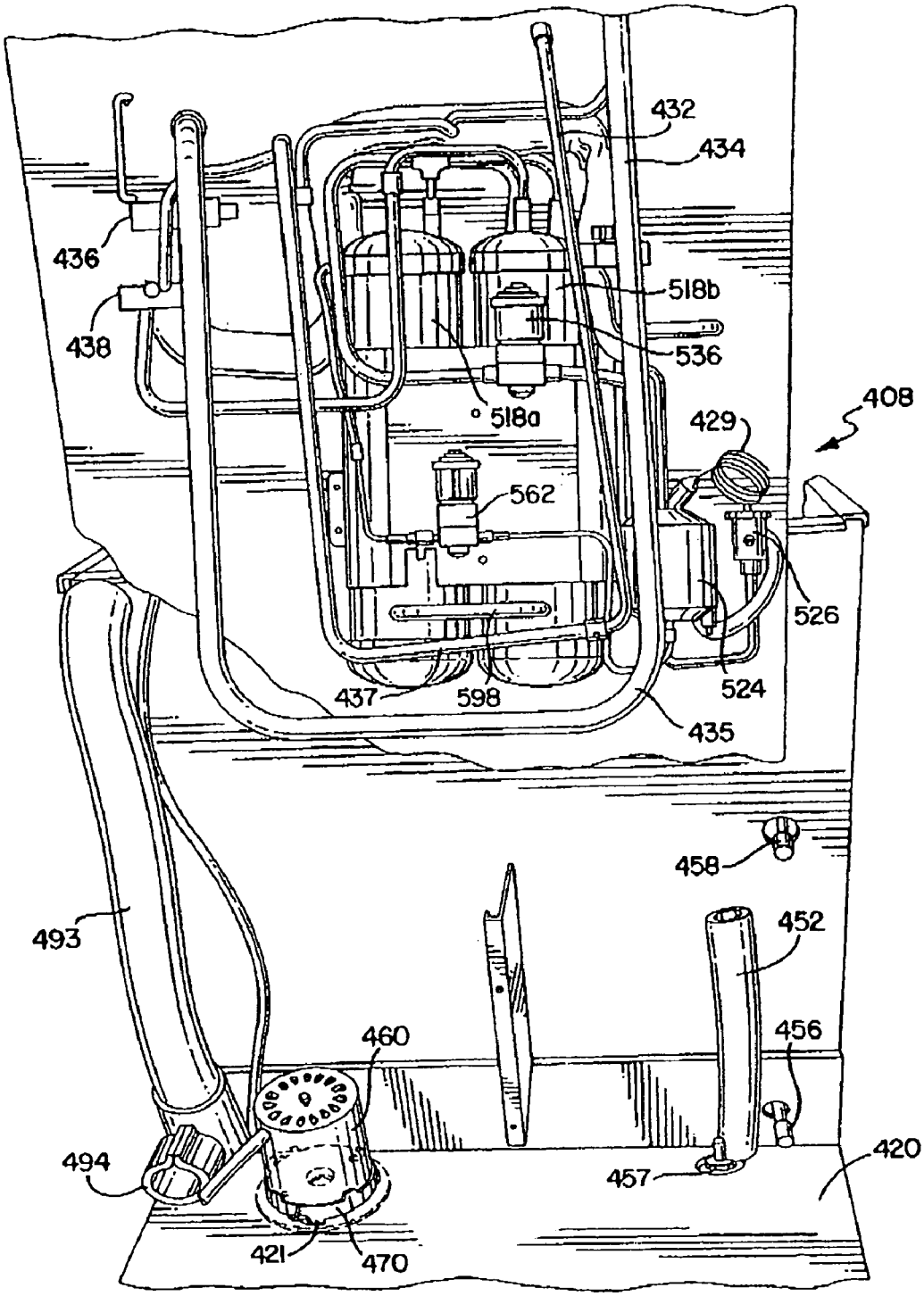
FIG. 17 is an exploded partial view of the rear of the ice making unit of FIG. 15.
Figure 18:
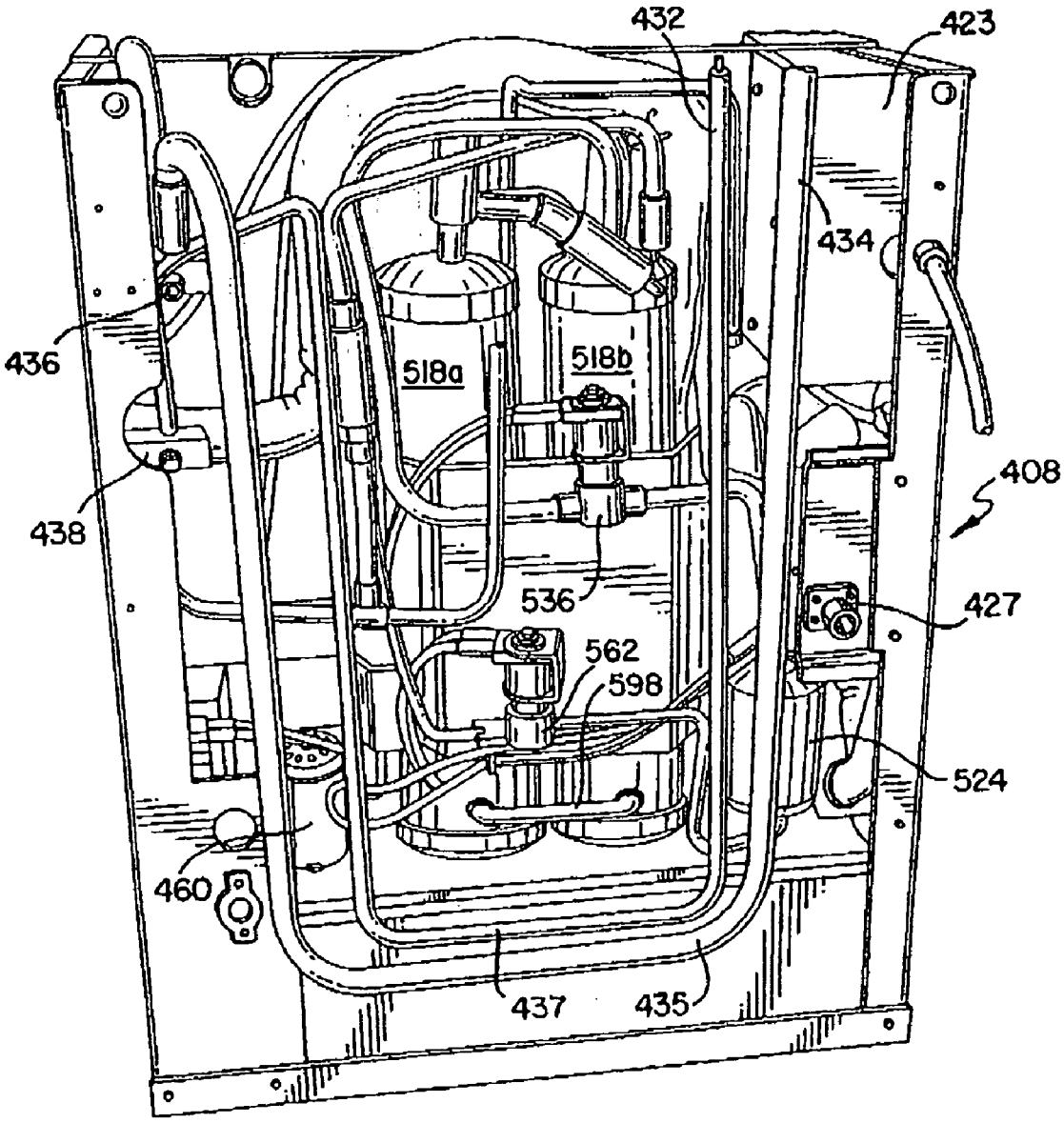
FIG. 18 is a perspective view of the rear of the ice making unit of FIG. 15 with the back panel removed.

FIGS. 17 and 18 show several other components of the ice making unit 408, such as service shut-off valves, 436 and 438, an injection port 457 for injection of cleaning/sanitizing solutions from an automatic cleaning system, an evaporator inlet fitting 456, an evaporator outlet fitting 458, a water inlet hose 452, thermal expansion valve 526 with its associated capillary tube and bulb 429, drier 524, liquid solenoid valve 562, cool vapor solenoid valve 536, water inlet solenoid valve 427, electrical box 423, and the suction line 432 and liquid line 434 that go to the remote condensing unit 402. The suction line 432 and liquid line 434 have service loops 435 and 437 provided so that the ice making unit 408 can be rotated on top of the ice and beverage dispenser 409 if a service technician needs to have access to the back of the ice making unit. The water level sensor can be a capacitance sensor as used on commercial Manitowoc ice machines, or some other type of sensor.

Figure 19:
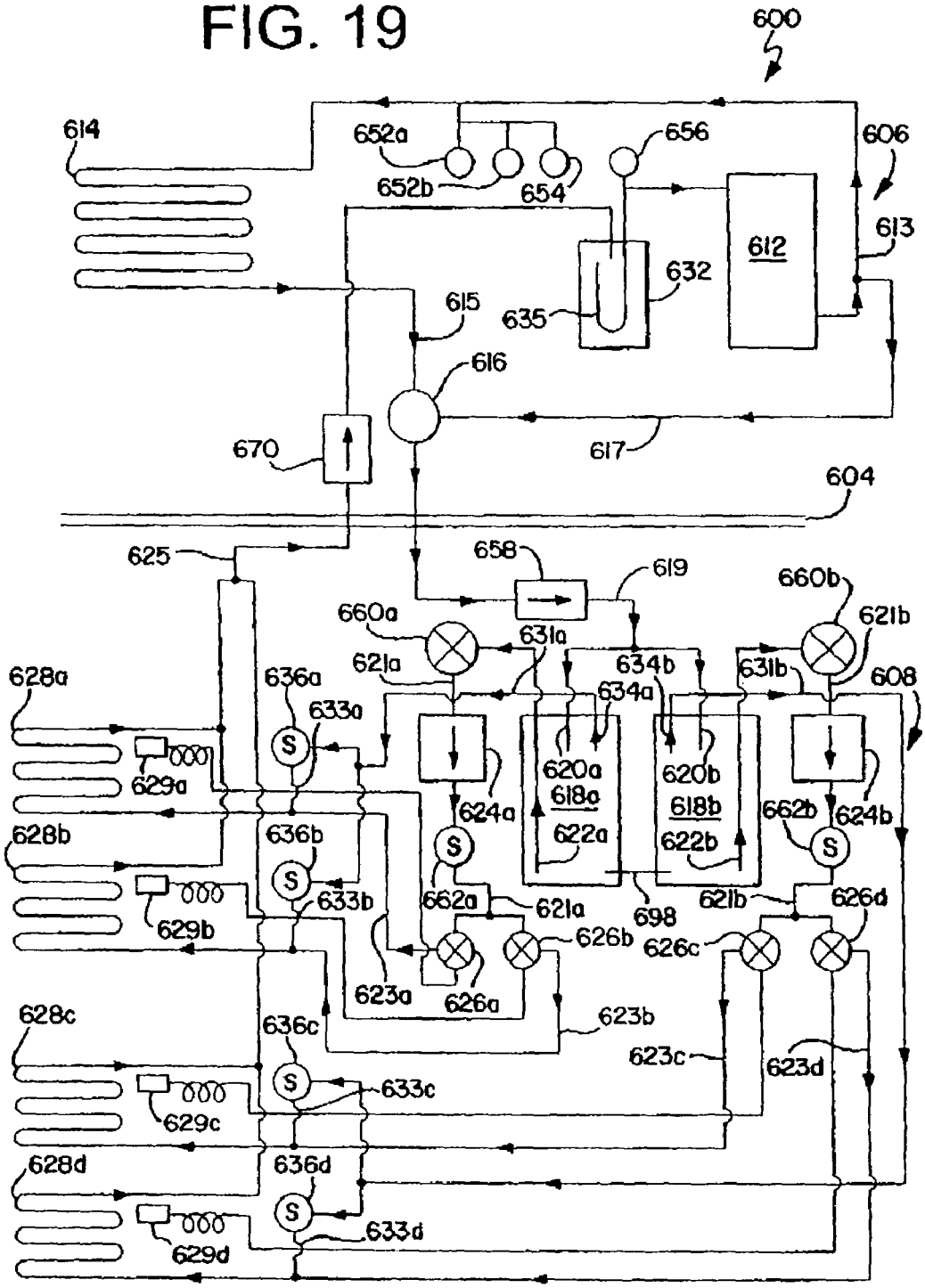
FIG. 19 is a schematic drawing of a sixth refrigeration system used in the present invention, using four evaporators and two interconnected receivers.

FIG. 19 shows a refrigeration system 600 that can be used with four evaporators 628*a*, 628*b*, 628*c* and 628*d*. The refrigeration system 600 has two receivers 618*a* and 618*b* like the two receivers in refrigeration system 500, and a suction line filter 670. Otherwise, the components are like those in the multi-evaporator refrigeration system 300 of FIG. 10. Therefore, reference numbers in FIG. 19 have an addend of 300 compared to the reference numbers in FIG. 10. Also, where parts were duplicated, such as two thermal expansion valves 326*a* and 326*b* in FIG. 10, there are four parts in FIG. 19, such as four thermal expansion valves 626*a*, 626*b*, 626*c* and 626*d* in refrigeration system 600. Four sets of capillary tubes and sensing bulbs 629*a-d* allow the evaporators 628*a-d* to operate independently. Also, there are two fan cycling controls 652*a* and 652*b*.

The pump assembly adapter 470, best shown in FIGS. 21-27, is preferably made of injection molded plastic and is then constructed with the pump motor 460 and pump housing 490 into the pump assembly. Studs extending from the motor are fastened to the sleeve 491, sandwiching the adapter 470 between the motor 460 and the pump housing 490. Using the adapter 470, the pump assembly can be removed and inserted so that the motor 460 extends into the machine compartment through base 420.

The adapter 470 includes a motor deck 472 and a flange 474. The motor 460 is centered on the deck 472 by four extensions 475. In the center of the deck 472, a series of reduced diameter shoulders 476, 477 and 478 are formed. These are used to center the shaft (not shown) from the motor to the pump housing and hold a felt washer that prevents water from coming up the shaft to the motor 460.

The flange 474 includes two locking tabs 480. The locking tabs have a slot 481 (FIG. 27) in them extending in from one side, as will be explained hereafter. The base 420 of the machine compartment has a hole in it the same diameter as the deck 472. There are two locking tab clearance slots 421, one of which can be seen in FIG. 17, extending out from this hole. When the assembly is raised, so that the motor 460 passes through the hole in the base 420, the deck 472 is able to pass through as well, up until the flange 474 hits the bottom of the base 420. The locking tabs 480 pass through the clearance slots 421. As the pump assembly is rotated clockwise (looking from above), the slots 481 allow the sheet metal of the base 420 to pass through until it hits the stop 483 at the end of the locking tab 480. In this position, a stud (not shown) can pass through a hole (not shown) in the base 420 that is aligned with a hole 471 in the flange 474. The stud is part of a standard quarter-turn fastener 486 (FIG. 20), and has a receptacle (not shown) on the top of the base 420. The stud prevents the adapter 470 from rotating. However, when the pump assembly needs to be removed, the quarter-turn fastener can be turned back, the stud removed from the receptacle and hole 471, and the adaptor 470 can then be rotated. This rotation brings the locking tabs back over the clearance slots, and the entire pump assembly can be dropped into the reservoir area. Preferably, the pump motor has an electric cord and plug on it that plugs into a mating electrical connector extending from the electrical box 423. This pump wire is preferably sufficiently long so that the plug and mating connector pass down through the hole in the base 420 and are visible to the service technician, who can then easily disconnect the electrical wiring to the pump.

As shown in FIG. 15, the compact size of the ice making unit 408 allows the ice making unit to be mounted on the top of the ice storage bin section of the ice and beverage dispenser 409 with a good deal of clearance between the front of the ice storage bin and the front of the ice making unit cabinet 414. This clearance is preferably covered by a cover 411 during normal use. However, the cover 411 can be removed so that the ice storage bin 412 can be cleaned. Also, if peak demand exceeds the storage of ice, additional ice can be added to the top of the ice storage bin 412 while the cover 411 is removed.

It is preferable that the cabinet 414 have a depth D, a width W and a height H, at least one of which is less than 18 inches. It is most preferable that the depth D be of less than 18 inches, preferably less than 16 inches, and most preferably about 14 inches or less. The width W of the cabinet 414 will preferably be the same as the width of the ice and beverage dispenser, such as about 22 inches or less. However, the compact size of the ice machine may also, or alternatively, allow for a width W less than the width of the ice storage bin 412. The height H of the cabinet 414 will preferably be less than 32 inches. In one preferred embodiment, the cabinet 414 has a height of 30½ inches, a width of 22 inches, and a depth of only 14 inches. Yet, the ice making unit has a capacity of 900 pounds of ice per day when tested under Air Conditioning and Refrigeration Institute (ARI) standard testing conditions of 90° F. ambient temperature and 70° F. ambient inlet water temperature. This unit has a capacity-to-volume ratio of 166 pounds of ice/day/$ft^3$ of cabinet volume. Two smaller capacity units have also been developed in smaller height cabinets, one that produces 680 pounds of ice per day under the standard ARI test conditions, and the other which produces 570 pounds of ice per day under the standard ARI test conditions. These ice making machines have capacity-to-volume ratios of 144 pounds of ice/day/$ft^3$ and 133 pounds of ice/day/$ft^3$, respectively. By comparison, a fairly efficient ice machine from another company has a cabinet measuring 48×26×24 inches and has a reported capacity of 1855 pounds of ice per day at ARI standard test conditions, resulting in a capacity-to-volume ratio of 107 pounds of ice/day/$ft^3$ Another machine on the market has a cabinet measuring 48×22×28 inches and a capacity of 2024 pounds of ice per day. This is only a capacity-to-volume ratio of 118 pounds of ice/day/$ft^3$ Thus, these larger machines, which should have a better capacity-to-volume ratio, fall short of 125 pounds of ice/day/$ft^3$, whereas all three of the compact machines utilizing the present invention meet the 125 ratio and two of them meet the more preferable 140 pounds of ice/day/$ft^3$ ratio. Of course, very large industrial ice making equipment, which produces over 3,000 pounds of ice per day, may be able to produces ice at such a preferable capacity-to-volume ratio. However, for commercial ice making machines, which are rated at 2,500 pounds of ice per day or less, such a capacity-to-volume ratio is a great advantage.

As described above, the compact ice-making unit includes a water pump assembly mounted so that the pump motor is not located in the water compartment. Another advantage of the water pump assembly described above is that the entire pump assembly can be removed from the front part of the ice-making unit without the need for tools. An alternative embodiment of a water pump assembly is illustrated in FIGS. 28-35. The water pump assembly according to the alternative embodiment can be utilized in the ice-making machine described herein, as well as in a variety of other ice-making machines.

Figure 28A:
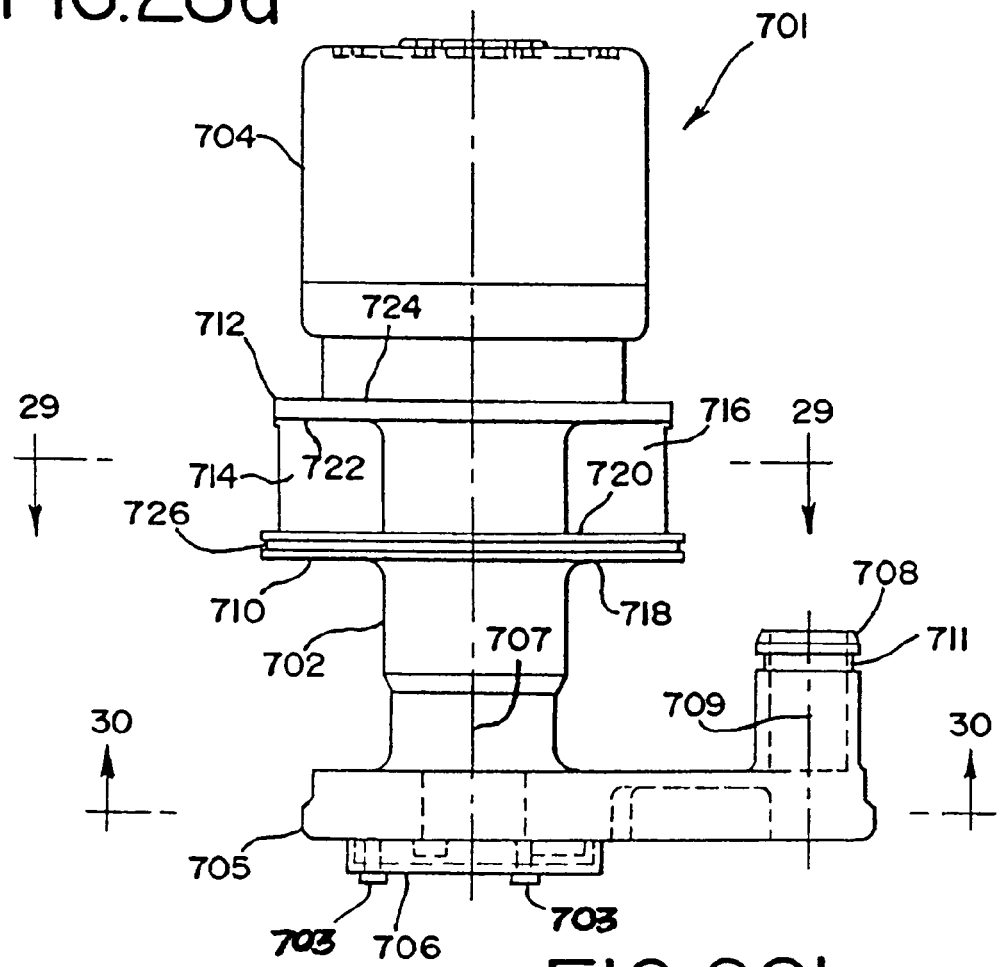
FIG. 28*a* is a side view of a pump assembly including a pump motor and pump housing in accordance with another embodiment of the invention.

FIG. 28*a* is a side view of a pump assembly 701 in accordance with the alternative embodiment of the invention. Pump assembly 701 includes a pump housing 702 and a pump motor 704. Pump housing 702 includes an impeller housing 705 and a discharge tube 708. An impeller shaft axis 707 runs down the center of pump housing 702 from motor 704 and an impeller shaft (not shown) connects to an impeller 735 (shown in FIG. 30) located in impeller housing 705. Impeller housing 705 includes a grate 706 (FIG. 28*a*)

attached to a lower portion of the impeller housing. Grate 706 covers an opening (not shown) in impeller housing 705 through which water can be drawn into impeller housing 705 during operation of pump motor 704. Grate 706 is held in place by pegs 703 protruding from the bottom of impeller housing 705.

Discharge tube 708 has a center axis 709 and a circumferential seat 711. Circumferential seat 711 is configured to accommodate a sealing device, such as an O-ring or the like. In accordance with the invention, the distance between impeller shaft axis 707 and discharge tube axis 709 is preferably about 3.37 inches to about 3.38 inches and, more preferably about 3.375 inches.

Pump housing 702 also includes a first flange (or sealing flange) 710 and a second flange (or mounting flange) 712 extending from pump housing 702. First and second flanges 710 and 712 are connected by first and second braces 714 and 716, respectively, extending in the same direction as shaft axis 707.

Each of first and second flanges 710 and 712 have upper and lower surfaces and the thickness of each flange is defined by the distance between the upper and lower surfaces. First flange 710 has a lower surface 718 and an upper surface 720. Correspondingly, second flange 712 has a lower surface 722 and an upper surface 724. In accordance with the invention, the thickness of first flange 710 is preferably about 0.25 inches, and the thickness of second flange 712 is preferably about 0.188 inches. Further, in accordance with a preferred embodiment of the invention, lower surface 722 of second flange 712 is about 1.143 inches from upper surface 720 of first flange 710.

In accordance with the invention each of first and second flanges 710 and 712 can be characterized by a diameter defined by a line extending from the peripheral edge of each flange through impeller shaft axis 707. In accordance with the invention, first flange 710 has a diameter of preferably about 4.201 inches to about 4.211 inches and, more preferably, about 4.206 inches. Correspondingly, second flange 712 has a diameter of about 3.952 inches. Accordingly, first flange 710 has a larger diameter than second flange 712.

Figure 28B:
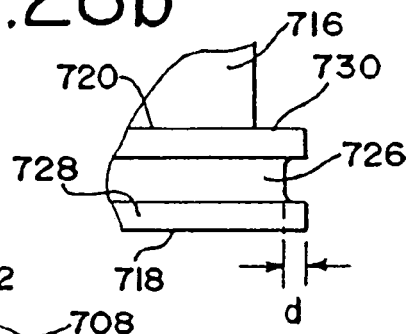
FIG. 28*b* is an enlarged view of a portion of the pump housing illustrated in FIG. 28*a*.

First flange 710 includes a circumferential seat 726. Circumferential seat 726 is configured to accommodate a sealing device, such as an O-ring or the like. An enlarged view of a portion of pump housing 702 is illustrated in FIG. 28*b*. Circumferential seat 726 resides between a lower rim 728 and an upper rim 730. Each of lower and upper rims 728 and 730 has a thickness defined by the distance between a bottom of the rim and a top of the rim. Lower rim 728 has a thickness defined by the distance between lower surface 718 and circumferential seat 726. In accordance with the invention, the thickness of lower rim 728 is about 0.072 inches. Upper rim 730 has a thickness defined by the distance between circumferential seat 726 and upper surface 720. In accordance with the invention, the thickness of upper rim 730 is about 0.073 inches. Further, the width of circumferential seat 726 is defined by the distance between lower rim 728 and upper rim 730. In accordance with the invention, the width of circumferential seat 726 is about 0.105 inches. Also, upper and lower rims 728 and 730 extend outwardly in a radial direction past circumferential seat 726 by a distance "d". In accordance with the invention, the distance d is preferably about 0.052 inches to about 0.054 inches and, more preferably, about 0.053 inches.

As will subsequently be described, pump assembly 701 is designed to mate with a base within an ice-making machine. The base functions as a mounting member for installation of pump assembly 701 into the ice-making machine. The particular dimensions of pump assembly 701 are specified to coincide with the dimensions of openings in the base for insertion of pump housing 702 and discharge tube 708.

Figure 29:
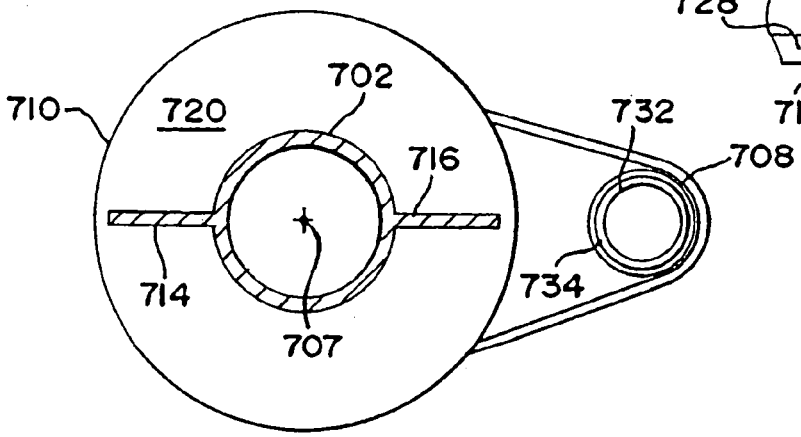
FIG. 29 is partial cross-sectional view of the pump housing illustrated in FIG. 29*a* taken along section line 29-29 of FIG. 28*a*.

A partial cross-sectional view of pump housing 702 taken along section line 29-29 of FIG. 28*a* is illustrated in FIG. 29. Braces 714 and 716 are generally aligned on opposite sides of pump housing 702 and laterally disposed along a direction passing through impeller shaft axis 707. In accordance with the invention, discharge tube 708 has an inner wall 732 and an outer wall 734. In accordance with the invention, the inner diameter of discharge tube 708 is about 0.931 inches. Also, the outer diameter of discharge tube 708 is preferably about 1.050 inches to about 1.010 inches and, more preferably, about 1.055 inches.

A cross-sectional view of impeller housing 705 is illustrated in FIG. 30. An impeller 735 is attached to an impeller shaft (not shown) aligned with shaft axis 707 and rotates in a clockwise direction about impeller shaft axis 707. Impeller 735 is equipped with a plurality of vanes 736 positioned on a rotary platform 738. A channel 740 extends around the perimeter of rotary platform 738 and a passageway 742 connects channel 740 to discharge tube 708.

FIG. 31 is a perspective view of pump housing 702 and pump motor 704. Pump motor 704 is enclosed within a cowling 744 that includes a plurality of cooling vents 746 in a top: portion of the cowling. Cooling vents 746 permit the flow of cooling air through cowling 744 during operation of pump motor 704. In one embodiment of the invention, an O-ring 748 is positioned within circumferential seat 726 of first flange 710. An O-ring 750 is also positioned within circumferential seat 711 of discharge tube 708. As will subsequently be described, O-rings 748 and 750 form liquid tight seals against a base when pump assembly 701 is installed within an ice-making machine. Those skilled in the art will appreciate that other kinds of seals, such as gaskets, washers, tape, and the like, can also be used and that the configuration of the circumferential seats can be altered to accommodate other kinds of seals.

Figure 32:
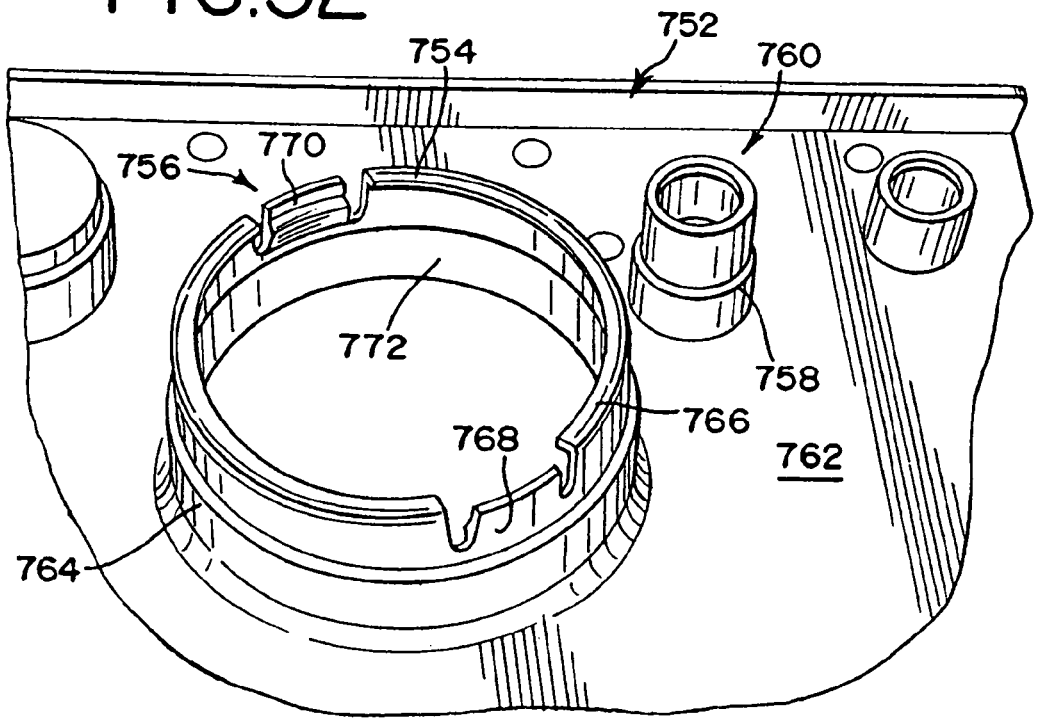
FIG. 32 is a perspective view of a base and collar for use with the pump assembly of FIG. 28*a* configured in accordance with the invention.

FIG. 32 illustrates a perspective view of a portion of a base 752 configured in accordance with the invention. Base 752 includes a collar 754 surrounding a pump opening 756. A sleeve 758 surrounds a second opening 760 formed in base 752 in proximity to pump opening 756. Both collar 754 and sleeve 758 project above a floor 762 of base 752.

Collar 754 includes a sealing section 764 and a latching section 766. In the illustrated embodiment, both sealing section 764 and latching section 766 are integrally formed with base 752. Further, sealing section 764 has a larger diameter than latching section 766. When pump motor 704 and pump housing 702 are inserted into pump opening 756, the perimeter of first flange 710 seals against an interior sealing surface 772 of sealing section 764. Latching section 766 is segmented into four segments including opposing collar segments 768 and 770. As will subsequently be described, opposing collar segments 768 and 770 function as snap latches that engage second flange 712 to hold pump motor 704 and pump housing 702 in position within pump opening 756. Although the present embodiment is illustrated with two opposing latches, those skilled in the art will recognize that other latching configurations are possible. For example, only one snap latch or more than two snap latches can be formed in latching section 766. In a preferred embodiment of the invention, base 752 and collar 754 are formed of a resilient plastic material having a high hardness. For example, base 752 and collar 754 can be formed from plastic materials, such as an acrylonitrile butadiene styrene (ABS) plastic.

Figure 33:
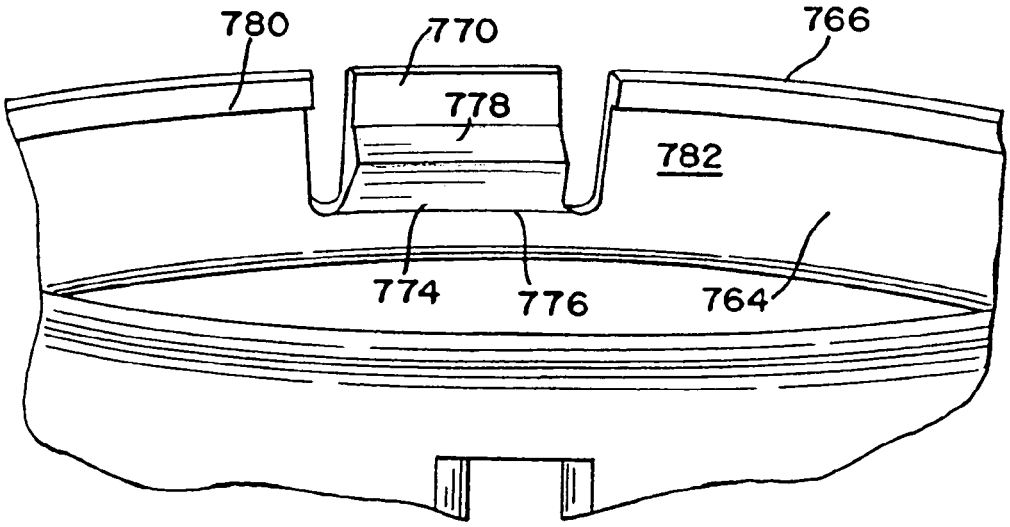
FIG. 33 is a perspective view of portion of the collar illustrated in FIG. 32.

A perspective view of a portion of collar 754 is illustrated in FIG. 33. Each of opposing collar segments 768 and 770 are configured to deflect outwardly when pump housing 702 is inserted through pump opening 756. As illustrated in FIG. 33, collar segment 770 has a beveled projection 774 that extends along an inner surface 776 of collar segment 770. Beveled projection 774 extends inwardly toward the center of opening 756, then changes directions and extends back toward collar segment 770 forming a sloping surface 778. The remaining segments of latching section 766 have an upper rim 780. Upper rim 780 forms a lip that extends inwardly around the inner perimeter of latching section 766. The opposing collar segments 768 and 770 hold pump housing 702 in place against upper rim 780 and an inner surface 782 of latching section 766.

Referring back to FIGS. 28*a* and 32, when pump housing 702 is inserted into pump opening 756, upper surface 724 of second flange 712 is pressed against upper rim 780. Opposing collar segments 768 and 770 are sufficiently flexible, such that they are first deflected away from second flange 712 as the flange presses against beveled projection 774 as pump housing 702 is inserted into pump opening 756. Once second flange 712 is urged passed the apex of bevel projection 774, opposing collar segments 768 and 770 return to an unbent position, such that sloping surface 778 fits against a peripheral portion of second flange 712. Once opposing collar segments 768 and 770 reflect back against second flange 712, the flange is firmly held between upper rim 780 and sloping surface 778. The force exerted by opposing collar segments 768 and 770 is sufficient to hold pump motor 704 and pump housing 702 in position in pump opening 756 against the force of gravity.

Figure 34:
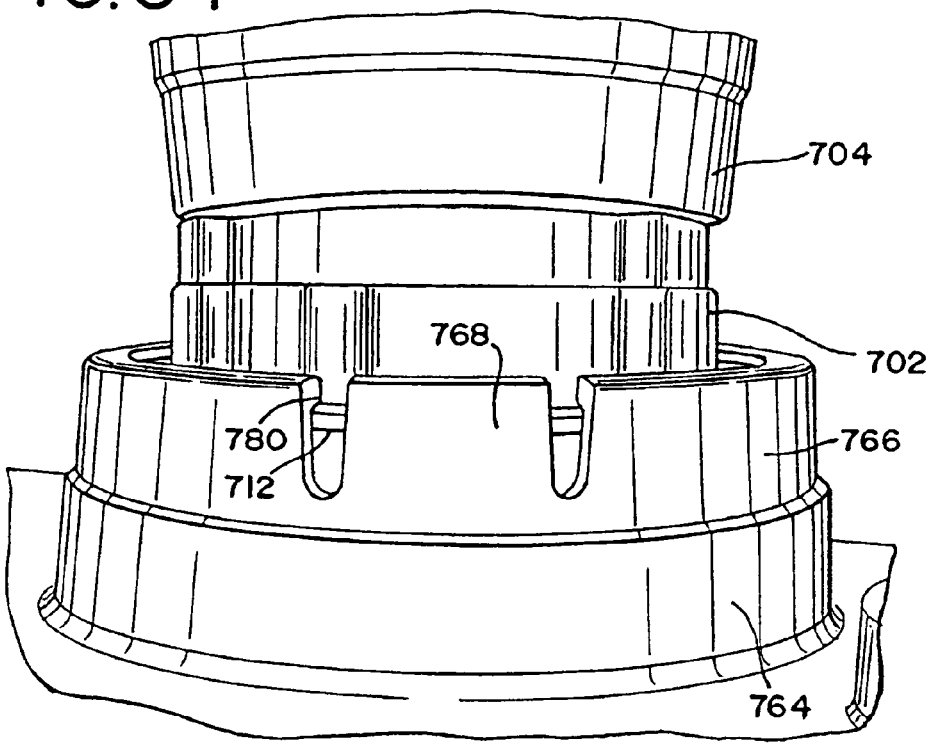
FIG. 34 is a side view of the pump housing illustrated in FIG. 28*a* positioned within the collar illustrated in FIG. 32.

FIG. 34 illustrates a side view of pump housing 702 positioned within pump opening 756. Opposing collar segment 768 is pressed against the peripheral surface of second flange 712, which forces second flange 712 up against upper rim 780. In accordance one embodiment of the invention, opposing collar segments 768 and 770 function as snap latches to hold pump motor 704 and pump housing 702 in position. As used herein, the term "snap latches" can apply to any type of protrusion projecting from the inner surface of a collar in a pump deck. Further, the protrusions can be either beveled or un-beveled and associated with a collar that is either segmented or un-segmented.

Figure 35:
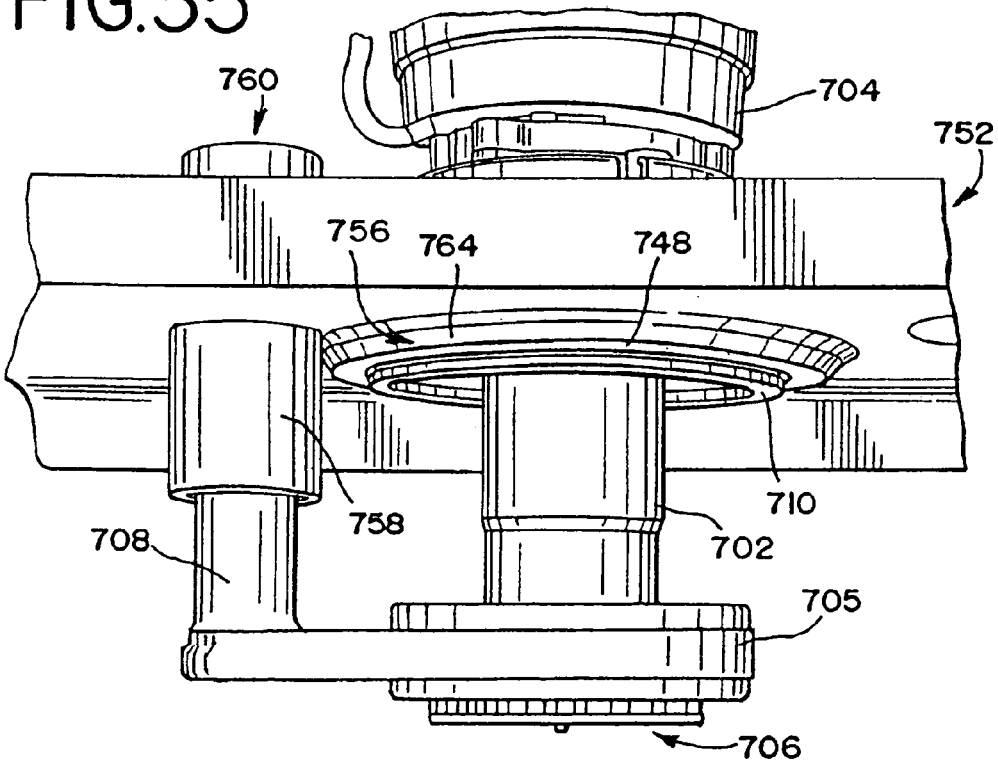
FIG. 35 is a perspective view of the pump assembly illustrated in FIG. 28*a* positioned within the base illustrated in FIG. 32.

FIG. 35 illustrates a perspective view of pump housing 702 partially positioned within opening 756 of base 752. A portion of first flange 710 is positioned immediately below pump opening 756. As illustrated, O-ring 748 is ready to slide against interior sealing surface 772 of sealing section 764. Also, discharge tube 708 is positioned within sleeve 758 of second opening 760 in base 752. Once installed in base 752, grate 706 of impeller housing 705 will be submerged in water, while O-rings 748 and 750 (shown in FIG. 31) will prevent water from entering into the space above base 752. Also, the sealing arrangement prevents air and contaminants from the mechanical compartment from entering the water compartment.

Those skilled in the art will appreciate that other attachment mechanisms can be employed to hold the pump assembly within the opening in the pump deck. For example, rather than segmenting the collar in combination with beveled projections to provide opposing snap latches, the collar can be continuous and two or more protrusions similar to beveled projections 774 can be provided on the inner surface of a continuous collar. Alternatively, the protrusions, or snap latches, can have square rather than rounded edges. Further, first flange 710 can include a plate with an opening similar to hole 471 provided in flange 474 of adapter 470 shown in FIGS. 21-25. A threaded shaft and wing nut, a quarter-turn fastener, or other hand operable attachment device can be inserted through the opening to secure the pump assembly to the pump deck.

Upon review of FIG. 35, those skilled in the art will appreciate that the dimensions of pump assembly 701, described above and illustrated in FIG. 28*a*, substantially coincide with the diameter and spacing of openings 756 and 760 in base 752. In particular, the distance between axis 707 and 709 corresponds to the distance between the centers of openings 756 and 760 respectively. Further, the outer diameters of first flange 710 and discharge tube 708 substantially coincide with the inside diameters of interior sealing surface 772 and opening 760, respectively. In this way, pump assembly 701 can be reliably and precisely inserted into base 752. Correspondingly, the dimensional match between pump assembly 701 and the openings in base 752 is such that pump assembly 701 can be removed without the use of tools by grasping pump housing 702 and exerting a downward force.

Those skilled in the art will note that the alternative embodiment described and illustrated in FIGS. 28-35 is similar to the earlier embodiment illustrated in FIGS. 20-27 in that both enable installation and removal of the pump housing without the use of tools. The embodiments differ, however, in the locking mechanism. While the earlier embodiment provides an adapter and locking tabs, the later embodiment provides a collar and snap latches. Further, the earlier embodiment relies upon rotation of the pump assembly and a quarter turn fastener to hold the pump assembly in place, while the latter embodiment relies on pressure exerted by the snap latches. Although the embodiments structurally differ, both provide a mechanism to install and remove a pump housing by accessing only the water compartment of the ice-making machine. Access to the mechanical compartment is unnecessary. Accordingly, both embodiments provide a fast and convenient method of servicing the water pump used in an ice-making machine.

It will be appreciated that the addition of some other process steps, materials or components not specifically included will have an adverse impact on the present invention. The best mode of the invention may therefore exclude process steps, materials or components other than those listed above for inclusion or use in the invention. However, the described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

The invention claimed is:

1. A pump assembly mounted within an ice machine having a base, the base having an opening and a collar surrounding the opening, the collar having an upper rim on an interior surface thereof and a sealing surface displaced away from the upper rim, the pump assembly comprising:

(a) a pump housing attached to a pump motor and enclosing an impeller;

(b) a discharge tube;

(c) a first flange and a second flange extending from the pump assembly, the first flange having a larger diameter than the second flange and having a circumferential seat; and (d) an O-ring residing within the circumferential seat, wherein the O-ring seals against the sealing surface of the collar, wherein the second flange is configured to fit against the upper rim on the interior surface of the collar, and wherein the collar exerts pressure on the second flange to hold the pump assembly in place.

2. The pump assembly of claim 1 further comprising an impeller shaft enclosed within the pump housing and extending from the pump motor and coupled to the impeller, wherein the distance between a center axis of the impeller shaft and a center axis of the discharge tube is about 3.375 inches.

3. The pump assembly of claim 2 wherein the base includes a second opening, and wherein the discharge tube inserts into the second opening.

4. The pump assembly of claim 3 wherein the discharge tube has an outside diameter of about 1.055 inches.

5. The pump assembly of claim 1 wherein the first and second flanges each have upper and lower surfaces, and wherein the distance between the upper surface and the lower surface of each flange defines a flange thickness.

6. The pump assembly of claim 5 wherein the lower surface of the second flange is about 1.143 inches from the upper surface of the first flange.

7. The pump assembly of claim 5 wherein the flange thickness of the second flange is about 0.118 inches and the flange thickness of the first flange is about 0.25 inches.

8. The pump assembly of claim 1 wherein the first flange has a diameter of about 4.2 inches and the second flange has a diameter of about 3.95 inches.

9. The pump assembly of claim 1 wherein the collar comprises a segmented ring including two opposed ring segments.

10. The pump assembly of claim 9 wherein an inner surface of the two opposed ring segments comprises a beveled projection extending from the interior surface of the collar.

11. The pump assembly of claim 10 wherein, upon insertion of the motor and pump housing into the opening of the base, the opposed ring segments are configured to bend outwardly when the second flange presses against the beveled projection and to return to an unbent position after a lower surface of the second flange passes an apex of the beveled projection.

12. An ice machine with a pump assembly mounted therein, the ice machine comprising:

(a) a base having a pump opening in a floor thereof;

(b) a collar projecting above the floor and surrounding the pump opening;

(c) a first collar section having a first diameter and a segmented collar section having an upper rim and having a second diameter, wherein the first diameter is greater than the second diameter; and (d) opposing collar segments in the segmented collar section, wherein each of the opposing collar segments has a beveled projection on an inner surface thereof;

and the pump assembly comprising:

(e) a pump housing attached to a pump motor and enclosing an impeller;

(f) a discharge tube; and (g) a first flange and a second flange extending from the pump assembly, the first flange having a larger diameter than the second flange, wherein an upper perimeter portion of the second flange presses against the upper rim of the segmented collar section.

13. The pump assembly of claim 12 further comprising:

(a) a interior sealing surface in the first collar section;

(b) a circumferential O-ring seat in the first flange; and (c) an O-ring residing within the circumferential seat, wherein the O-ring seals against the sealing surface of the first collar section.

14. The ice machine of claim 12 wherein the base includes a second opening, and wherein the discharge tube inserts into the second opening.

15. The ice machine of claim 14 further comprising an impeller shaft enclosed within the pump housing and extending from the pump motor and coupled to the impeller, wherein the distance between a center axis of the impeller shaft and a center axis of the discharge tube is about 3.375 inches.

16. The ice machine of claim 15 wherein the discharge tube has an outside diameter of about 1.055 inches.

17. The ice machine of claim 15 wherein the pump housing further comprises at least two braces extending in a direction parallel to the center axis of the impeller shaft and connected to the first and second flanges.

18. The ice machine of claim 12 wherein the first flange has a diameter of about 4.20 inches and the second flange has a diameter of about 3.95 inches.

19. In combination, a pump assembly and an ice machine mounting base comprising:

(a) a mounting base having a floor and a pump opening in the floor;

(b) a pump motor;

(c) a pump housing attached to the pump motor, wherein the pump housing is positioned within the pump opening;

(d) a collar surrounding the pump opening and projecting above the floor, the collar having a sealing section and a latching section, wherein an interior diameter of the sealing section is greater than an interior diameter of the latching section;

(e) an upper lip in the latching section of the collar;

(f) opposed snap latches in the latching section each having an inner surface and a beveled projection extending from the inner surface; and (g) a mounting flange extending from the pump assembly, the mounting flange having an upper surface and a lower surface and a peripheral portion, wherein the peripheral portion engages the opposed snap latches, such that the lower surface presses against the beveled projection of the opposed snap latches and the upper surface presses against the upper lip to hold the pump motor and pump housing in place.

20. The combination of claim 19 wherein the snap latches comprise flexible tabs in the latching section.

21. The combination of claim 19 further comprising a sealing flange extending from the pump housing, the sealing flange having a circumferential O-ring seat and an O-ring positioned within the circumferential seat, wherein the O-ring seals against an interior surface of the sealing section.

22. The combination of claim 21 further comprising at least two braces extending along an outer surface of the pump assembly and connecting the mounting flange and the sealing flange.

23. The combination of claim 21 wherein the sealing flange has an upper and a lower surface, wherein the distance between the upper surface and the lower surface of the mounting flange defines a mounting flange thickness and the distance between the upper surface and the lower surface of the sealing flange defines a sealing flange thickness, and wherein the mounting flange thickness is about 0.118 inches and sealing flange thickness is about 0.25 inches.

24. The combination of claim 21 wherein the lower surface of the mounting flange is about 1.143 inches from the upper surface of the sealing flange.

25. The combination of claim 21 wherein the sealing flange has a diameter of about 4.2 inches and the mounting flange has a diameter of about 3.95 inches.

26. The combination of claim 19 wherein the snap latches engage the mounting flange, such that the pump motor and pump housing can be removed through the pump opening and replaced without the use of tools.

27. The combination of claim 19 wherein the pump housing further comprises:

an impeller housing opposite the pump motor;

a discharge tube displaced away from the impeller housing; and a channel in the pump housing connecting the impeller housing with the discharge tube.

28. The combination of claim 27 wherein the mounting base includes a second opening, and wherein the discharge tube inserts into the second opening.

29. The combination of claim 27 wherein the discharge tube has an outside diameter of about 1.055 inches.

30. The combination of claim 19 wherein the beveled projection further comprises a sloped surface that presses against the lower edge of the mounting flange.

31. A pump assembly comprising:

(a) a pump housing attached to a pump motor and enclosing an impeller;

(b) a discharge tube down stream from the impeller;

(c) a first flange and a second flange extending from the pump assembly, the first flange having a larger diameter than the second flange and having a circumferential O-ring seat; and (d) at least two braces positioned between and connected to the first flange and the second flange.

32. The pump assembly of claim 31 wherein the first and second flanges each have upper and lower surfaces, and wherein the distance between the upper surface and the lower surface of each flange defines a flange thickness.

33. The pump assembly of claim 32 wherein the flange thickness of the second flange is about 0.118 inches and the flange thickness of the first flange is about 0.25 inches.

34. The pump assembly of claim 32 wherein the lower surface of the second flange is about 1.143 inches from the upper surface of the first flange.

35. The pump assembly of claim 31 wherein the first flange has a diameter of about 4.2 inches and the second flange has a diameter of about 3.95 inches.

36. The pump assembly of claim 31 further comprising an impeller enclosed within the pump housing and having a center axis wherein the distance between the center axis of the impeller shaft and a center axis of the discharge tube is about 3.375 inches.

37. The pump assembly of claim 31 further comprising an impeller housing surrounding the impeller and a channel in the pump housing connecting the impeller housing and the discharge tube.

38. The pump assembly of claim 31 wherein the discharge tube has an outside diameter of about 1.055 inches.

39. A method of mounting a pump assembly in an ice machine comprising:

(a) providing a mounting base having a pump opening and a collar surrounding the pump opening, the collar having opposed snap latches;

(b) providing a pump motor and pump housing attached to the pump motor, the pump assembly having a mounting flange and a sealing flange, the sealing flange configured to seal against a sealing surface of the collar; and (c) inserting the pump and pump housing into the pump opening until the snap latches engage the mounting flange and the sealing flange seals against the sealing surface, wherein the pump motor resides above the mounting base and at least a portion of the pump housing resides below the mounting base.

40. The method of claim 39 wherein inserting the pump housing comprises pressing a peripheral portion of the mounting flange against the snap latches, such that the snap latches first deflect away from the mounting flange, then reflect against the peripheral portion and capture the peripheral portion between an upper lip of the collar and a sloped interior surface of the snap latches.

41. The method of claim 40 wherein inserting the pump housing further comprises pressing an O-ring located in circumferential seat in the sealing flange against the sealing surface of the collar.

42. The method of claim 39 wherein providing a collar further comprises providing a collar having a latching section and a sealing section, wherein the sealing section has a diameter and the latching section has a diameter, and wherein the diameter of the sealing section is greater than the diameter of the latching section.

43. The method of claim 42 wherein providing a collar having opposed snap latches comprises providing a segmented latching section, and wherein the snap latches comprises segments formed in an upper edge of the latching section.

44. The method of claim 39 wherein providing a pump housing comprises providing a pump housing having an impeller housing at an opposite end of the pump housing from the pump motor, and wherein inserting the pump and pump housing into the pump opening comprises positioning the impeller housing below the base.

45. The method of claim 44 wherein providing a pump housing comprises providing a pump housing having a discharge tube connected thereto, and wherein inserting the pump and pump housing into the pump opening comprises inserting the discharge tube into a second opening in the base.

46. The method of claim 45 wherein inserting the pump and pump housing into the pump opening until the snap latches engage the mounting flange and inserting the discharge tube into the second opening comprises manual manipulation of the pump and pump housing without the use of tools.

47. An ice making unit comprising:

a) a cabinet having a front panel covering a front panel opening;

b) a water compartment behind the front panel;

c) a divider between the mechanical compartment and the water compartment, the divider having an opening therein;

d) a collar surrounding the opening, the collar having snap latches therein; and e) a pump assembly comprising a motor and a pump housing, the pump assembly having a mounting flange, wherein the pump assembly extends though the opening, such that the motor resides in the mechanical compartment and the pump housing resides in the water compartment, and wherein the snap latches engage the mounting flange to hold the pump motor and pump housing in place.

48. The ice making unit of claim 47 wherein the snap latches comprise opposing segments in the collar, and wherein each of the opposing collar segments has a beveled projection on an inner surface thereof.

49. The ice making unit of claim 48 wherein the collar further comprises an upper rim, and wherein the mounting flange is configured to fit against the upper rim, and wherein the beveled projections exert pressure on the mounting flange to hold the pump assembly in place.

50. The ice making unit of claim 48 wherein the pump assembly further comprises a sealing flange, the sealing flange having a circumferential O-ring seat and an O-ring positioned within the circumferential seat, wherein the O-ring seals against an interior surface of the opening.

51. A pump assembly including a motor enclosed within a cowling and a pump housing attached to the pump motor, the pump assembly comprising:

(a) a sleeve surrounding a shaft extending from the pump motor;

(b) an impeller housing enclosing an impeller attached to an end of the shaft;

(c) a discharge tube down stream from the impeller; and (d) a flange surrounding the sleeve, the flange extending outwardly from the sleeve beyond an outer edge of the motor cowling, wherein the flange is configured to cooperate with attachment structures associated with a pump opening in an ice machine, such that the pump assembly can be inserted into and removed from and held within the pump opening without the use of tools.

52. The pump assembly of claim 51 wherein the attachment structures comprise a collar surrounding the opening and at least two projections protruding from an inner surface of the collar, such that the flange rests on the at least two projections and supports the pump assembly.

53. The pump assembly of claim 51 wherein the flange includes a plate extending laterally therefrom and having a hole therein, which cooperates with the attachment structures, wherein the attachment structures comprise a hand operable attachment device inserted through the hole to secure the pump assembly in the opening.

54. An ice making unit having a cabinet including a front panel covering a front panel opening, a water compartment behind the front panel, a mechanical compartment, and a divider between the mechanical compartment and the water compartment, and a water system inside the cabinet including a pump which is part of a pump assembly, the pump assembly comprising:

(a) a motor and a pump housing, the pump assembly extending through an opening in the divider such that the pump motor is in the mechanical compartment and the pump housing is in the water compartment; and (b) a flange extending outwardly from the pump assembly beyond an outer edge of the motor, wherein the flange cooperates with attachment structures on the divider, such that the pump assembly can be removed through the front panel opening and replaced without the use of tools.

55. In combination, a pump assembly and an ice machine mounting base comprising:

(a) a mounting base having a floor and a pump opening in the floor;

(b) a pump motor;

(c) a pump housing attached to the pump motor, wherein the pump housing is positioned within the pump opening;

(d) a collar surrounding the pump opening and projecting above the floor, the collar having an upper lip and inwardly extending protrusions on an inner surface thereof; and (e) a flange extending from the pump assembly, the flange having an upper surface and a lower surface and a peripheral portion, wherein the peripheral portion engages the collar, such that the lower surface rests on the protrusions and the upper surface presses against the upper lip to hold the pump motor and pump housing in place.

* * * * *